US011406197B1

(12) United States Patent
Flannery et al.

(10) Patent No.: US 11,406,197 B1
(45) Date of Patent: Aug. 9, 2022

(54) PULL UP PUSH DOWN BED RAIL

(71) Applicant: Regalo International, LLC, Burnsville, MN (US)

(72) Inventors: Mark A. Flannery, Longboat Key, FL (US); Kasey L. Pipo, Elko New Market, MN (US)

(73) Assignee: Regalo International, LLC, Burnsville, MN (US)

( * ) Notice: Subject to any disclaimer, the term of this patent is extended or adjusted under 35 U.S.C. 154(b) by 0 days.

(21) Appl. No.: 17/061,529

(22) Filed: Oct. 1, 2020

(51) Int. Cl.
*A47C 21/08* (2006.01)

(52) U.S. Cl.
CPC ..... *A47C 21/08* (2013.01)

(58) Field of Classification Search
CPC ..... A61G 7/0516; A61G 7/18; A61G 7/19; A47C 21/08
See application file for complete search history.

(56) References Cited

U.S. PATENT DOCUMENTS 4,439,880 A * 4/1984 Koncelik ..... A61G 7/0507 5/425
6,952,846 B2 10/2005 Flannery et al.
7,137,158 B2 * 11/2006 Flannery ..... A47C 21/08 5/425
7,178,184 B2 2/2007 Flannery et al.
7,181,788 B2 2/2007 Flannery et al.
7,302,720 B2 12/2007 Flannery et al.
7,640,606 B2 1/2010 Flannery et al.
7,908,689 B2 3/2011 Flannery
7,913,333 B2 3/2011 Flannery et al.
8,091,163 B2 1/2012 Flannery
8,365,324 B2 2/2013 Flannery
8,458,831 B2 6/2013 Flannery et al.
8,555,436 B2 10/2013 Flannery et al.
8,631,525 B2 1/2014 Flannery
8,726,433 B1 5/2014 Flannery et al.
8,966,682 B1 3/2015 Flannery et al.
9,125,498 B2 9/2015 Flannery
9,155,400 B1 10/2015 Flannery et al.
9,265,353 B1 2/2016 Flannery et al.
9,387,141 B1 7/2016 Flannery et al.
9,687,081 B1 6/2017 Flannery
10,117,524 B1 11/2018 Flannery et al.
10,548,408 B1 2/2020 Flannery et al.
10,617,222 B1 4/2020 Flannery
10,674,837 B1 6/2020 Flannery et al.
2007/0089242 A1 * 4/2007 Battiston ..... A47C 21/08 5/662
2012/0084916 A1 * 4/2012 Flannery ..... A47C 21/08 5/426

FOREIGN PATENT DOCUMENTS

CN 203538771 U * 4/2014

* cited by examiner

*Primary Examiner* — Peter M. Cuomo
*Assistant Examiner* — Adam C Ortiz

(57) ABSTRACT

The present pull up push down bed rail includes first and second bases that engage a bed, upper and lower cross supports extending between the bases to be adjacent to a near side of the bed to close off any gap between the near side of the bed and the bed rail, and a U-shaped support member having end members that engage the bases. The bases include through openings for the end members that extend into and through the through openings such that the U-shaped support member is pushable down, after which the U-shaped support member is pullable up. Sheeting is engaged to the U-shaped support member.

5 Claims, 14 Drawing Sheets

PULL UP PUSH DOWN BED RAIL

FIELD OF THE INVENTION

The present invention relates to a bed rail, particularly a bed rail that slides up and slides down, and specifically to such a bed rail that is portable and may be readily assembled and readily disassembled by the end user without destroying the integrity of the bed rail.

BACKGROUND OF THE INVENTION

Swing down bed rails swing. This feature results in the caretaker stepping up to the bed and bed rail, then manipulating the mechanism that permits the bed rail to swing down, then stepping away from the bed so that the bed rail can swing out of the bed and simultaneously holding the bed rail that is swinging down, and setting the bed rail down softly in the swing down position and simultaneously stepping back toward the bed.

Swing down bed rails have lock mechanisms to hold the swing down rail in an upright position. These lock mechanisms perform dual functions. First, the lock mechanisms lock and unlock for the caregiver such that the caregiver may open and close the bed rail. Second, when locked, the lock mechanisms resist pressure from a force pushing outward against the bed rail. This pressure may come, for example, from a child rolling against the bed rail. Or this pressure may come from a child using his or her legs to press against the bed rail when the bed rail is in a locked position.

SUMMARY OF THE INVENTION

A feature of the present invention is the provision in a bed rail, of a pull up push down bed rail for a bed, where the bed includes a sleeping surface.

Another feature of the present invention is the provision in a bed rail, of first and second bases that engage the bed and of each of the first and second bases having a through opening, where the through opening includes an uppermost portion and a bottommost portion.

Another feature of the present invention is the provision in a bed rail, of a U-shaped support member having first and second end portions and a cross portion extending between the first and second end portions, where the first end portion engages the through opening of the first base and the second end portion engages the through opening of the second base, and where the cross portion of the U-shaped support member is disposed at a location higher than the first and second bases.

Another feature of the present invention is the provision in a bed rail, of the U-shaped support member having a pulled up position and a pushed down position, where the cross portion of the U-shaped support member is spaced from the first and second base and is further disposed at a location higher than the sleeping surface of the bed when the U-shaped support member is in the pulled up position, where the cross portion of the U-shaped support member is adjacent to the first and second bases when the U-shaped support member is in the pushed down position.

Another feature of the present invention is the provision in a bed rail, of an upper cross support member extending between the first and second bases and of a lower cross support member extending between the first and second bases, where the upper and lower cross support members fix the first and second bases apart from each other.

Another feature of the present invention is the provision in a bed rail, of the upper and lower cross support members defining a first plane and of the U-shaped support member defining a second plane, where the first and second planes are offset from each other, and where the first and second planes are adjacent to each other.

Another feature of the present invention is the provision in a bed rail, of the first plane being between the bed and the second plane so as to dispose the upper and lower cross support members adjacent to a near side of the bed and minimize any gap between the upper and lower cross support members and a side of the bed.

Another feature of the present invention is the provision in a bed rail, of each of the first and second bases including a rear portion, where the rear portion includes upper and lower extensions that extend toward the near side of the bed, where each of the upper extensions include an upper seat for receiving one end of the upper cross support member, where each of the lower extensions include a lower seat for receiving one end of the lower cross support member such that the upper and lower extensions and upper and lower cross support members are disposed adjacent to the near side of the bed.

Another feature of the present invention is the provision in a bed rail, of the first base including a first foot extending transversely of an axis of the through opening of the first base, of the second base including a second foot extending transversely of an axis of the through opening of the second base, where each of the first and second feet extends rearwardly so as to extend into the near side of the bed, and where each of the first and second feet includes a receptor for engagement to an arrangement that engages a far side of the bed.

Another feature of the present invention is the provision in a bed rail, of the first base and first foot being integral and one-piece with each other, where the second base and second foot are integral and one-piece with each other.

Another feature of the present invention is the provision in a bed rail, of the first base and first foot being part of a first rigid piece and of the second base and second foot being part of a second rigid piece.

Another feature of the present invention is the provision in a bed rail, of sheeting, where the sheeting includes a front sheet portion, a rear sheet portion, a top edge portion, a bottom edge portion, a first upper end portion, a pair of first lower end portions, a second upper end portion, and a pair of second lower end portions, where the front sheet portion is spaced from the rear sheet portion by the top edge portion, the bottom edge portion, the first upper end portion, and the second upper end portion, where the top edge portion of the sheeting engages the cross portion of the U-shaped support member, where the bottom edge portion of the sheeting engages the lower cross support member, where the first upper end portion of the sheeting engages the first end portion of the U-shaped support member, and where the second upper end portion of the sheeting engages the second end portion of the U-shaped support member, where the first lower end portions of the sheeting are spaced from each other to create a space for the first base, and where the second lower end portions of the sheeting are spaced from each other to create a space for the second base such that the cross portion of the U-shaped support member is inside of the sheeting, such that sections of the first and second end portions of the U-shaped support member are inside of the sheeting, with other sections of the first and second end portions of the U-shaped support member being in the first and second bases, such that each of the upper and lower cross support members are inside of the sheeting, and such that each of the first and second bases are outside of the sheeting.

Another feature of the present invention is the provision in a bed rail, of at least a first cross support member extending between the first and second bases, where the first cross support member fixes the first and second bases apart from each other.

Another feature of the present invention is the provision in a bed rail, of the U-shaped support member having a pulled up position and a pushed down position, where the cross portion of the U-shaped support member in the pulled up position is spaced from the first and second bases and is further disposed at a location higher than the sleeping surface of the bed, where the cross portion of the U-shaped support member in the pushed down position is adjacent to the first and second bases, and where the U-shaped support member is lockable at the pulled up position.

Another feature of the present invention is the provision in a bed rail, of, in the pulled up position, a section of the first end portion of the U-shaped support member being disposed adjacent to the uppermost portion of the through opening of the first base.

Another feature of the present invention is the provision in a bed rail, of, in the pulled up position, a section of the second end portion of the U-shaped support member being disposed adjacent to the uppermost portion of the through opening of the second base.

Another feature of the present invention is the provision in a bed rail, of, in the pulled up position, a section of the first end portion of the U-shaped support member being disposed adjacent to the lowermost portion of the through opening of the first base.

Another feature of the present invention is the provision in a bed rail, of, in the pulled up position, a section of the second end portion of the U-shaped support member being disposed adjacent to the lowermost portion of the through opening of the second base.

Another feature of the present invention is the provision in a bed rail, of, in the pushed down position, a section of the first end portion of the U-shaped support member being disposed adjacent to the uppermost portion of the through opening of the first base.

Another feature of the present invention is the provision in a bed rail, of, in the pushed down position, a section of the second end portion of the U-shaped support member being disposed adjacent to the uppermost portion of the through opening of the second base.

Another feature of the present invention is the provision in a bed rail, of, in the pushed down position, a section of the first end portion of the U-shaped support member being disposed adjacent to the lowermost portion of the through opening of the first base.

Another feature of the present invention is the provision in a bed rail, of, in the pushed down position, a section of the second end portion of the U-shaped support member being disposed adjacent to the lowermost portion of the through opening of the second base.

Another feature of the present invention is the provision in a bed rail, of, in the pulled up position, a section of the first end portion of the U-shaped support member being disposed adjacent to and lower than the lowermost portion of the through opening of the first base, and of, in the pulled up position, a section of the second end portion of the U-shaped support member being disposed adjacent to and lower than the lowermost portion of the through opening of the second base.

Another feature of the present invention is the provision in a bed rail, of, in the pushed down position, a section of the first end portion of the U-shaped support member being spaced apart from and disposed lower than the lowermost portion of the through opening of the first base, and of, in the pushed down position, a section of the second end portion of the U-shaped support member being spaced apart from and disposed lower than the lowermost portion of the through opening of the second base.

Another feature of the present invention is the provision in a bed rail, of the first end portion of the U-shaped support member including a first stop extending from the first end portion and engaging a portion of the first base when the first end portion slides axially upwardly, where the first stop is disposed adjacent to and lower than the lowermost portion of the through opening of the first base when the U-shaped support member is in the pulled up position, where the second end portion of the U-shaped support member includes a second stop extending from the second end portion and engaging a portion of the second base when the second end portion slides axially upwardly, and where the second stop is disposed adjacent to and lower than the lowermost portion of the through opening of the second base when U-shaped support member is in the pulled up position.

Another feature of the present invention is the provision in a bed rail, of each of the first and second stops being retractable to reduce a width of the first and second end portions, respectively, such that first and second end portions are pullable up through and out of the through openings such that the U-shaped support member is pullable up and out of the first and second bases.

Another feature of the present invention is the provision in a bed rail, of a) the U-shaped support member being slideable between the pulled up position and the pushed down position, b) of the U-shaped support member being not slideable lower than the pushed down position without destroying an integrity of the pull up push down bed rail, c) of, in the pushed down position, the U-shaped support member being not locked to the first and second bases, c) of, from the pushed down position, the U-shaped support member being slideable upwardly freely immediately, d) of, from the pushed down position, the U-shaped support member being pullable up to the pulled up position where the U-shaped support member is lockable in the pulled up position to the first and second bases, e) of, from the pulled up position, the U-shaped support member being pushable down only after being unlocked from the first and second bases.

Another feature of the present invention is the provision in a bed rail, of, from the pulled up position, the U-shaped support member being pullable up and out of the first and second bases only when being unlocked from the first and second bases and further only when the first and second stops disposed on the first and second end members, respectively, are retracted.

Another feature of the present invention is the provision in a bed rail, of, in the pushed down position, further downward travel of the U-shaped support member being prevented by a) a first junction between the first end portion and the first cross support member, and b) a second junction between the second end portion and the first cross support member, where a distance between the first and second junction is less than a distance between an axis of the through opening of the first base and an axis of the through opening of the second base.

Another feature of the present invention is the provision in a bed rail, of the first end portion including a first bottommost section, of the second end portion including a second bottommost section, where the first end portion includes a first stop adjacent to the first bottommost section, where the second end portion includes a second stop adjacent to the second bottommost section, where the first stop and first end portion include an effective width greater than a width of the through opening of the first base, and where the second stop and second end portion include an effective width greater than a width of the through opening of the second base, such that the U-shaped member is stopped from sliding upwardly from the pulled up position by the first and second stops.

Another feature of the present invention is the provision in a bed rail, of each of the first and second stops including a spring biased button pushable into the first and second end portions, respectively, such that after the spring biased buttons are pushed in the U-shaped support member may be pulled completely out of the first and second bases.

Another feature of the present invention is the provision in a bed rail, of a first upper stop between the first base and the first end member and of a second upper stop between the second base and the second end member, where the first upper stop is engaged between the first base and the first end member in the pulled up position, where the first upper stop is disengaged between the first base and the first end member in the pushed down position, and where the second upper stop is engaged between the second base and the second end member in the pulled up position, and where the second upper stop is disengaged between the second base and the second end member in the pushed down position.

Another feature of the present invention is the provision in a bed rail, of the first upper stop being disengagable from one of the first end portion and first base such that the first end portion is pullable up and out of the first base, and of the second upper stop being disengagable from one of the second end portion and second base such that the second end portion is pullable up and out of the second base.

Another feature of the present invention is the provision in a bed rail, of a first lower stop extending from the first end portion, where the first lower stop is adjacent to and lower than the first base in the pulled up position, where the first lower stop is spaced from and lower than the first base in the pushed down position, and of a second lower stop extending from the second end portion, where the second lower stop is adjacent to and lower than the second base in the pulled up position, and where the second lower stop is spaced from and lower than the second base in the pushed down position.

Another feature of the present invention is the provision in a bed rail, of each of the first and second lower stops being retractable into the first and second end members, respectively, such that the first and second end members are pullable up and out of the first and second bases, respectively.

Another feature of the present invention is the provision in a bed rail, of a first upper stop engaged between the first end portion of the U-shaped support member and the first base when the first end portion is in the pulled up position to stop the first upright portion from sliding in both axial directions in the through opening of the first base, of a second upper stop engaged between the second end portion of the U-shaped support member and the second base when the second end portion is in the pulled up position to stop the second end portion from sliding in both axial directions in the through opening of the second base, of a first lower stop extending from the first end portion of the U-shaped support member and being adjacent to and lower than the first base in the pulled up position, where an effective width of the first end portion and first lower stop is greater than a width of the through opening of the first base to prevent the first end portion from being pulled through the through opening of the first base, and of a second lower stop extending from the second end portion of the U-shaped support member and being adjacent to and lower than the second base in the pulled up position, where an effective width of the second end portion and second lower stop is greater than a width of the through opening of the second base to prevent the second end portion from being pulled through the through opening of the second base.

Another feature of the present invention is the provision in a bed rail, of first, second, third, and fourth extensions, where the first and third extensions extend either into or from the first end portion of the U-shaped member, where the second and fourth extensions extending either into or from the second end portion of the U-shaped member, where each of the first and third extensions are retractable into either the first end portion or first base, where each of the second and third extensions are retractable into either the second end portion or second base, and where the U-shaped support member is pullable up and out of the first and second bases only when each of the first, second, third, and fourth extensions are retracted.

Another feature of the present invention is the provision in a bed rail, of first, second, third, fourth, and fifth units, where the first unit includes i) a first base having a through opening and a receptor; ii) a first intermediate cross member frame portion engaged to the first base; iii) a first lower cross member frame portion engaged to the first base; iv) a first foot having a proximal end portion and a distal end portion, the proximal end portion of the first foot being engagable to the receptor of the first base; v) a first flexible strap having a proximal end portion and a distal end portion, the proximal end portion of the first flexible strap being engaged to the first base, the first flexible strap further being engaged to the first foot; and vi) a first counter member for engaging a far side of the bed, the first counter member engaging the distal end portion of the first flexible strap.

Another feature of the present invention is the provision in a bed rail, of first, second, third, fourth, and fifth units, where the second unit includes i) a second base having a through opening and a receptor; ii) a second intermediate cross member frame portion engaged to the second base; iii) a second lower cross member frame portion engaged to the second base; iv) a second foot having a proximal end portion and a distal end portion, the proximal end portion of the second foot being engagable to the receptor of the second base; v) a second flexible strap having a proximal end portion and a distal end portion, the proximal end portion of the second flexible strap being engaged to the second base, the second flexible strap further being engaged to the second foot; and vi) a second counter member for engaging a far side of the bed, the second counter member engaging the distal end portion of the second flexible strap.

Another feature of the present invention is the provision in a bed rail, of first, second, third, fourth, and fifth units, where the third unit includes a first L-shaped frame member having an end portion and an upper frame member portion, the end portion of the first L-shaped portion being engagable with the through opening of the first base.

Another feature of the present invention is the provision in a bed rail, of first, second, third, fourth, and fifth units, where the fourth unit includes a second L-shaped frame member having an end portion and an upper frame member portion, the end portion of the second L-shaped portion being engagable with the through opening of the second base.

Another feature of the present invention is the provision in a bed rail, of first, second, third, fourth, and fifth units, where the fifth unit includes an upper cross member frame portion, the upper cross member frame portion having a first end portion and a second end portion.

Another feature of the present invention is the provision in a bed rail, of first, second, third, fourth, and fifth units, where the first and second units are engagable to each other by the first intermediate cross member frame portion of the first unit being engagable to the second intermediate cross member frame portion of the second unit and by the first lower cross member frame portion of the first unit being engagable to the second lower cross member frame portion of the second unit.

Another feature of the present invention is the provision in a bed rail, of first, second, third, fourth, and fifth units, where the third unit is engagable to the first unit by the end portion of the first L-shaped portion of the third unit being engagable in the through opening of the first base of the first unit.

Another feature of the present invention is the provision in a bed rail, of first, second, third, fourth, and fifth units, where the fourth unit is engagable to the second unit by the end portion of the second L-shaped portion of the fourth unit being engagable in the through opening of the second base of the second unit.

Another feature of the present invention is the provision in a bed rail, of first, second, third, fourth, and fifth units, where the fifth unit is engagable to the third unit by the first end portion of the upper cross member frame portion of the fifth unit being engagable to the upper frame member portion of the L-shaped portion of the third unit.

Another feature of the present invention is the provision in a bed rail, of first, second, third, fourth, and fifth units, where the fifth unit is engagable to the fourth unit by the second end portion of the upper cross member frame portion of the fifth unit being engagable to the upper frame member portion of the L-shaped portion of the fourth unit.

Another feature of the present invention is the provision in a bed rail, of first, second, third, fourth, and fifth units, where any disassembly of any of the first, second, third, fourth, or fifth units, such as breaking any particular unit down into two or more parts, destroys the integrity of such respective first, second, third, fourth, or fifth unit.

An advantage of the present invention is that a bed rail connection is relieved from having to do double duty. In other words, the connection that keeps the bed rail in the up position is not also the structure that resists the bed rail from being pushed outwardly. In still other words, the first and second bases of the present invention have elongate through openings that receive the U-shaped frame member of the bed rail, and it is this elongate relationship between the first and second bases and the end members of the U-shaped frame member that resists the bed rail from being pushed outwardly.

Another advantage of the present invention is that the caretaker can stand immediately adjacent to the bed when the bed rail is operated between the pulled up and pushed down position.

Another advantage of the present invention is that any gap that may exist between the near side of the bed and the bed rail is minimized by the pull up and push down structure that keeps the bed rail immediately at the near side of the bed.

Another advantage of the present invention is the bed rail is pullable up and out of the first and second bases only after both upper locks are retracted and both lower locks are retracted.

Another advantage of the present invention is the bed rail is pullable up from the pushed down position without operating any of the upper and lower locks.

Another advantage of the present invention is that, from the pushed down position, a positive act is required to keep pulling the U-shaped frame member completely out of the first and second bases, where the positive act is a pushing in of two spring biased lower locks.

Another advantage of the present invention is that the bed rail is pushable down from the pulled up position by operating the upper locks only.

Another advantage is that the upper locks snap in to a locked position and snap out to an unlocked position and that such upper locks remain at either the snapped in locked position or snapped out unlocked position until the caretaker snaps the locks in or snaps the locks out.

Another advantage of the present invention is that the sheeting does not hinder either the pull up or push down operation of the bed rail.

Another advantage is that the sheeting acts as a lock that prevents the U-shaped frame member from being pulled completely out of the first and second bases.

Another advantage of the present invention is that the present invention is shippable in a relatively small carton or package.

Another advantage of the present invention is that the present bed rail is readily assembled by an end user.

Another advantage of the present invention is that the present bed rail is readily disassembled to a compact form for storage or shipping or travel.

Another advantage of the present invention is that the bed rail is simple to assemble.

Another advantage of the present invention is that the bed rail is simple to disassemble.

Another advantage is that the bed rail is inexpensive to manufacture.

DESCRIPTION

Figure 1:
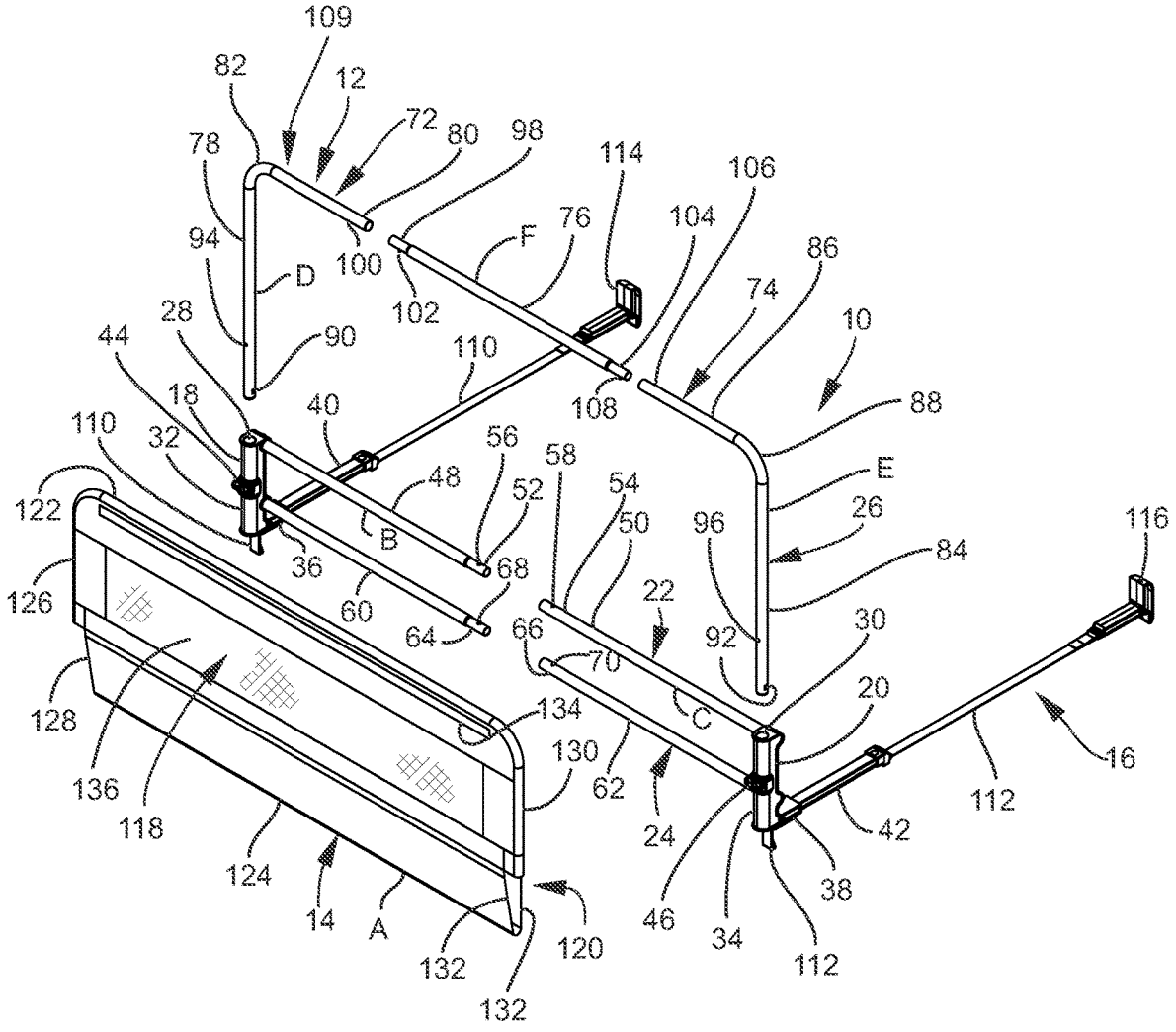
FIG. 1 is a perspective and partially exploded view of the present pull up push down bed rail.

As shown in FIG. 1, the present pull up push down bed rail is indicated by the reference number 10. Bed rail 10 includes a frame 12, sheeting 14, and a counter member arrangement 16.

Frame 12 includes first and second bases 18, 20 engaged to each other and fixed apart from each other by upper and lower cross tubular frame support members 22, 24. First and second bases 18, 20 are further engaged to each other and fixed apart from each other by a U-shaped tubular frame member 26. The first and second bases 18, 20 have respective vertically extending through openings 28, 30. Each of the first and second bases 18, 20 are L-shaped so as to have respective vertically extending portions 32, 34 and respective horizontally extending portions or feet or feet portions 36, 38. Each of the horizontally extending portions 36, 38 is a receiver or seat for a respective metal piece or tube or foot or foot portion 40, 42 that is part of the counter member arrangement 16. Each of the first and second bases 18, 20 further includes a respective stop apparatus or lock apparatus 44, 46 that locks the U-shaped frame member 26 to the first and second bases 18, 20. First and second bases 18, 20 extend parallel to each other. Axis of through openings 28, 30 extend parallel to each other. Horizontally extending portions 36, 38 run parallel to each other such that, when pieces 40, 42 are engaged therein, such pieces 40, 42 run parallel to each other.

Upper cross support member 22 incudes first and second tubular frame portions 48, 50. An outer section of frame portion 48 is fixedly engaged, such as by a rivet, in a receiver or seat formed by first base 18. An outer section of frame portion 50 is fixedly engaged, such as by a rivet, in a receiver or seat formed by second base 20. An inner section of frame portion 48 includes a male connector 52 that engages a female connector 54 on frame portion 50. A spring biased button 56 in male connector 52 engages a button opening 58 in female connector 54.

Lower cross support member 24 incudes first and second tubular frame portions 60, 62. An outer section of frame portion 60 is fixedly engaged, such as by a rivet, in a receiver or seat formed by first base 18. An outer section of frame portion 62 is fixedly engaged, such as by a rivet, in a receiver or seat formed by second base 20. An inner section of frame portion 60 includes a male connector 64 that engages a female connector 66 on frame portion 62. A spring biased button 68 in male connector 64 engages a button opening 70 in female connector 66.

Upper and lower cross support members 22, 24 extend parallel to each other. Upper and lower cross support members 22, 24 define a plane. The axis of through openings 28, 30 define a plane that is offset from, adjacent to, and parallel to the plane defined by upper and lower cross support members 22, 24.

Frame 12 further includes the U-shaped frame member 26 that in turn includes first and second L-shaped frame tube portions 72, 74 and a straight frame tube portion 76. First tube portion 72 includes an end vertical straight member section 78, a straight horizontal transversing section 80, and a curved transition section 82 between sections 78 and 80. Second tube portion 74 includes an end vertical straight member section 84, a straight horizontal transversing section 86, and a curved transition section 88 between sections 84 and 86. The lower end of end member section 78 includes a spring biased button or lock or stop or extension 90. The lower end of end member section 84 includes a spring biased button or lock or stop or extension 92. An intermediate portion of end member section 78 includes a hole 94 for engaging lock apparatus 44 of first base 18. An intermediate portion of end member section 84 includes a hole 96 for engaging lock apparatus 46 of second base 20.

Straight tube portion 76 includes an outer end section that includes a male connector 98 that engages a female tube connector 100 on the inner end of section 80. Male connector 98 includes a spring biased button 102 that engages a button hole in the female tube connector 100. Straight tube portion 76 includes another outer end section that includes a male connector 104 that engages a female tube connector 106 on the inner end of section 86. Male connector 104 includes a spring biased button 108 that engages a button hole in the female tube connector 106. U-shaped support or frame member 26 defines a plane that is co-planar with the plane defined by the axis of through openings 28, 30 and that is adjacent to and offset from the plane defined by cross support members 22, 24. Sections 80, 86 and 76 make up a transversing cross support member 109 that is parallel to cross members 22, 24. Transversing cross support member 109 is part of the U-shaped frame member 26. End member section 78 makes up an end or end member of the U-shaped frame member 26. End member section 84 makes up an end or end member of the U-shaped frame member 26. End member section 78 is parallel to end member section 84. Sections 78 and 84 define a plane of the U-shaped support member 26. U-shaped support member 26 as a whole also defines this plane.

Counter member arrangement 16 includes pieces 40, 42 that respectively engage the receivers in first and second bases 18, 20. Counter member arrangement 16 further includes straps 110, 112 and T-shaped counter members 114, 116 engaged to the ends of the respective straps 110, 112. Counter member arrangement 16 still further includes the first and second bases 18, 20, which include rear faces that counter the two upright inner faces of the T-shaped counter members 114, 116. The rear faces of the first and second bases 18, 20 confront a near side of a bed and the two upright inner faces of the T-shaped counter members 114, 116 confront the opposing far side of the bed such that the rear faces of the first and second bases 18, 20 and the upright inner faces of the T-shaped counter members 114, 116 hug the bed therebetween when the straps 110, 112 are tightened.

Sheeting 14 includes a front sheet portion 118, a rear sheet portion 120, a top edge portion 122, a bottom edge portion 124, a first upper end portion 126, a pair of first lower end portions 128, a second upper end portion 130, and a pair of second lower end portions 132. The front sheet portion 118 is spaced from the rear sheet portion 120 by the top edge portion 122, the bottom edge portion 124, the first upper end portion 126, and the second upper end portion 130. The top edge portion 122 of the sheeting 14 engages the cross portion 109 of the U-shaped support member 26. The bottom edge portion 124 of the sheeting 14 engages the lower cross support member 24. The first upper end portion 126 of the sheeting 14 engages the first end portion 78 of the U-shaped support member 26. The second upper end portion 130 of the sheeting 14 engages the second end portion 84 of the U-shaped support member 26. The first lower end portions 128 of the sheeting 14 are spaced from each other to create an opening into sheeting 14 and a space for the first base 18. The second lower end portions 132 of the sheeting 14 are spaced from each other to create an opening into the sheeting 14 and a space for the second base 20. Such a structure for sheeting 14 provides that the cross portion 109 of the U-shaped support member 26 is inside of the sheeting 14, provides that sections of the first and second end portions 78, 84 of the U-shaped support member 26 are inside of the sheeting 14, with other sections of the first and second end portions 78, 84 of the U-shaped support member 26 being in the first and second bases 18, 20, provides that each of the upper and lower cross support members 22, 24 are inside of the sheeting 14, and provides that each of the first and second bases 18, 20 are outside of the sheeting 14. Sheeting 14 further includes a top quick connect strip 134 on the front sheet portion 118 and an opposing quick connect strip on the rear sheet portion 120 of the sheeting 14. Inner faces of such top quick connect flexible strips engage each other with hook and loop connectors, such as Velcro® fabric connectors, so as to provide a sleeve, with top edge portion 122, for cross member 109. Sheeting 14 further includes a front rectangular mesh portion 136 engaged to the front sheet portion 118, with the rear sheet portion 120 having an identical mesh portion opposing, spaced from, and adjacent to mesh portion 136.

Figure 2A:
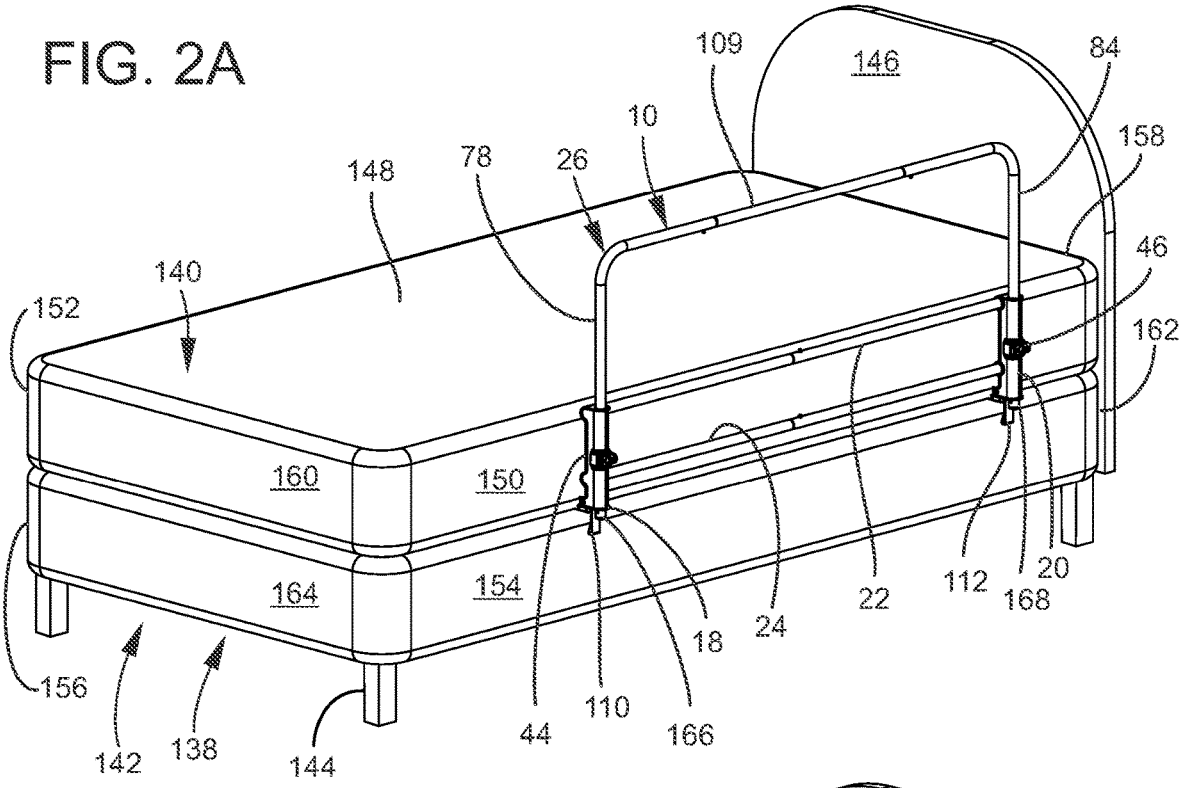
FIG. 2A is a perspective view of the pull up push down bed rail of FIG. 1 engaged to a bed in the pulled up position.
Figure 2B:
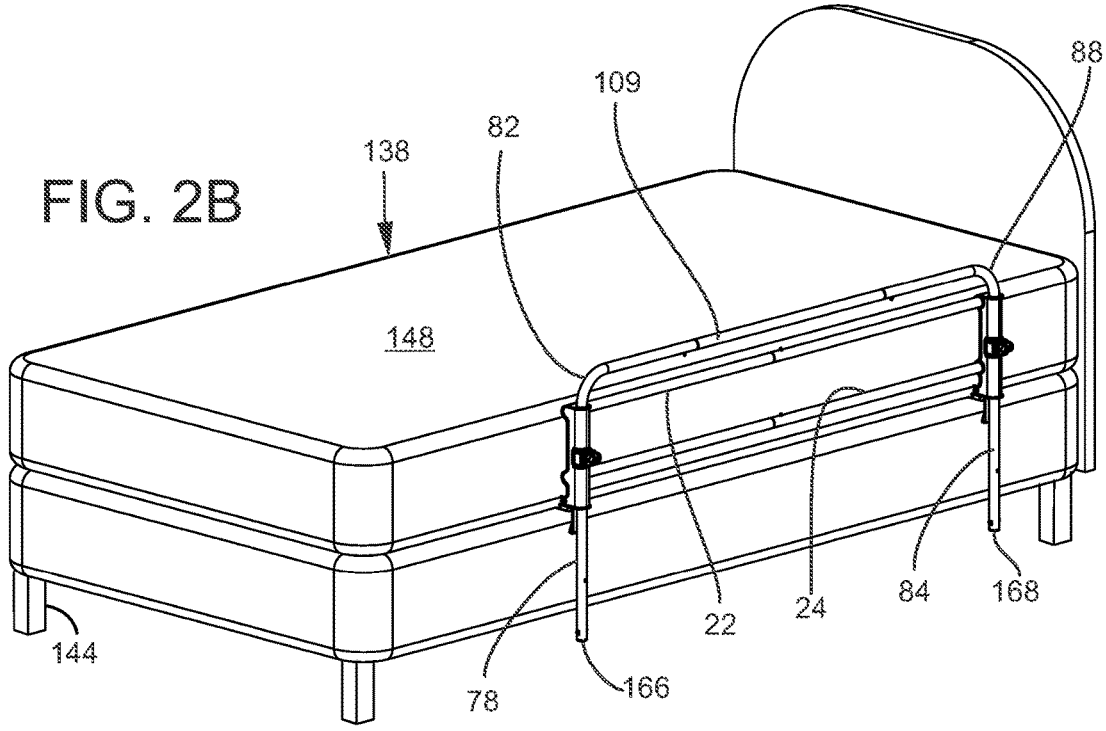
FIG. 2B is a perspective view of the pull up push down bed rail and bed of FIG. 2A in the pushed down position.

FIG. 2A shows the pull up push down bed rail 10 engaged to a bed 138 in a pulled up position. FIG. 2B shows the pull up push down bed rail 10 engaged to the bed 138 in a pushed down position.

Bed 138 includes a mattress 140, box spring or mattress support 142, a set of four legs 144, and a headboard 146. The mattress 140 has a sleeping surface 148. The mattress 140 includes a near side 150 and a far side 152. The mattress support 142 includes a near side 154 and a far side 156. Mattress 140 includes a head end 158 and a foot end 160. Mattress support 142 includes a head end 162 and a foot end 164.

FIGS. 2A, 2B show the bases 18, 20 engaging bed 138 by the L-shaped bases 18, 20 confronting the near side 150 of the mattress 140 and being pinched between the mattress 140 and the mattress support 142. Particularly, the horizontal portions 36, 38 of the bases 18, 20 are pinched between the mattress 140 and mattress support 142 and the rear sides of the bases 18, 20 are adjacent to the near side 150 of the mattress 140. The rear sides of the bases 18, 20 may make contact with the near side 150 of the mattress 140 and may extend into or dig into the near side 150 of the mattress 140. The height of each of the bases 18, 20 is about the height or thickness of the mattress 140. In the pulled up position of FIG. 2A, the cross member portion 109 of the U-shaped frame member 26 is disposed at a height greater than the sleeping surface 148 of the mattress 140. The upper cross member 22 is disposed in the plane of the sleeping surface 148 or adjacent to the plane of the sleeping surface 148. The lock apparatus 44, 46 have engaged the holes 94, 96 of the end members 78, 84. Lower ends 166, 168 of the end members 78, 84 extend beyond lower ends of the first and second bases 18, 20 and are adjacent to the lower ends of the first and second bases 18, 20.

In the pushed down position of FIG. 2B, the cross member 109 is adjacent to the sleeping surface 148 of the mattress 140, is further adjacent to the upper cross member 22, and is further adjacent to the top ends of the first and second bases 18, 20. The curved transition sections 82, 88 work as stops, by virtue of the decreased width provided thereby, to stop the U-shaped member 26 from being pushed further downwardly. The lower ends 166, 168 of the end members 78, 84 stop short of the floor on which the legs 144 rest and stop between such floor and the underside of the mattress support 142.

In each of FIGS. 2A and 2B, the U-shaped frame support member 26 is disposed in a plane that is parallel to the near sides 150, 154 of the mattress 140 and mattress support 142. In each of FIGS. 2A and 2B, sheeting 14 is engaged to the frame 12 of the bed rail 10, including to the U-shaped frame member 26 and to the lower cross member 24. In FIG. 2B, a top portion of the flexible sheeting 14 is scrunched down or pressed down or crumpled down or crimped down or packed down into irregular or corrugated like folds between the cross member 109 and the upper cross member 22, which scrunching down takes place automatically as the caretaker's hand pushes down on the cross member 109 of the U-shaped frame member 26. The corrugated like folds then disappear when the U-shaped frame member 26 is pulled up to the pushed up position in FIG. 2A such that the sheeting 26 provides a barrier to a child or other person who may roll against the sheeting 26. The U-shaped frame member 26 is stopped from being pulled up and out of the first and second bases 18, 20 by the stops 90, 92 that are spring biased to the locked position, i.e., to the extended position. After attaining the pulled up position, the caretaker manually snaps in locks 44, 46 to the locked position. It should be noted that sheeting 14 or 256 also stops the U-shaped frame member 26 from being pulled up and out of the first and second bases 18, 20. To pull the U-shaped frame member 26 completely out of the bases 18, 20, the locks of lock apparatus 44, 46 are retracted, the stops 90, 92 are retracted, and the sheeting 14 or 256 is removed.

Figure 3A:
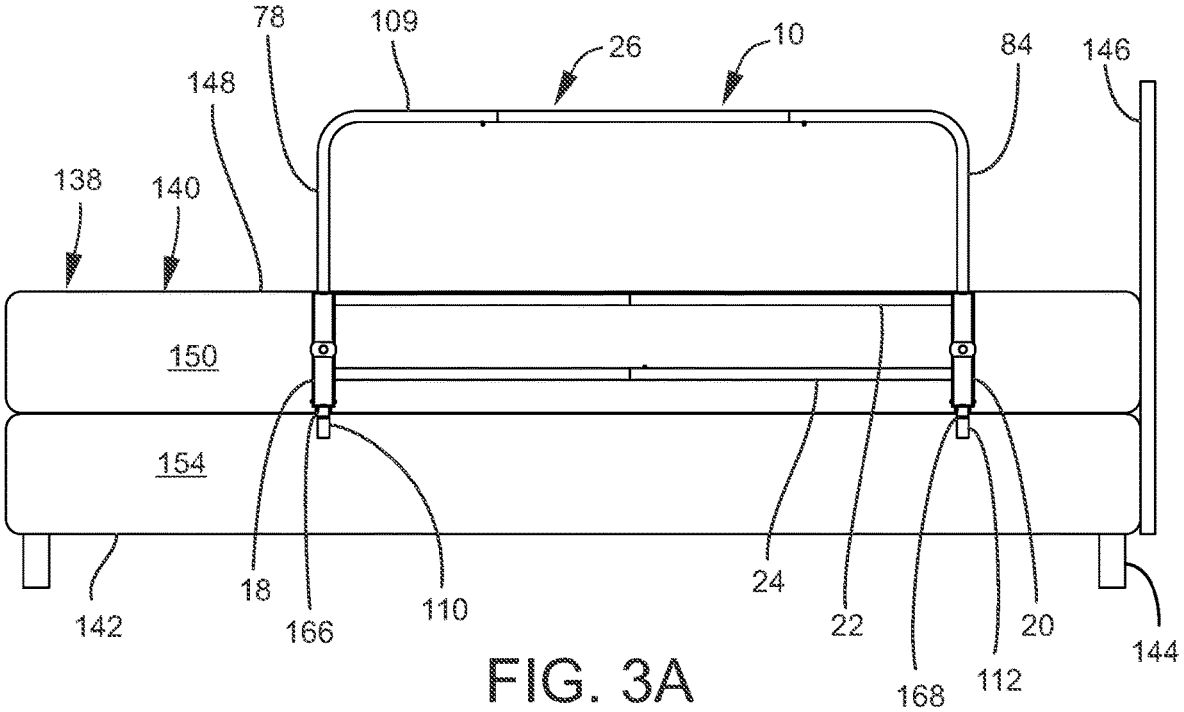
FIG. 3A is an elevation view of the pull up push down bed rail and bed of FIG. 2A in the pulled up position.
Figure 3B:
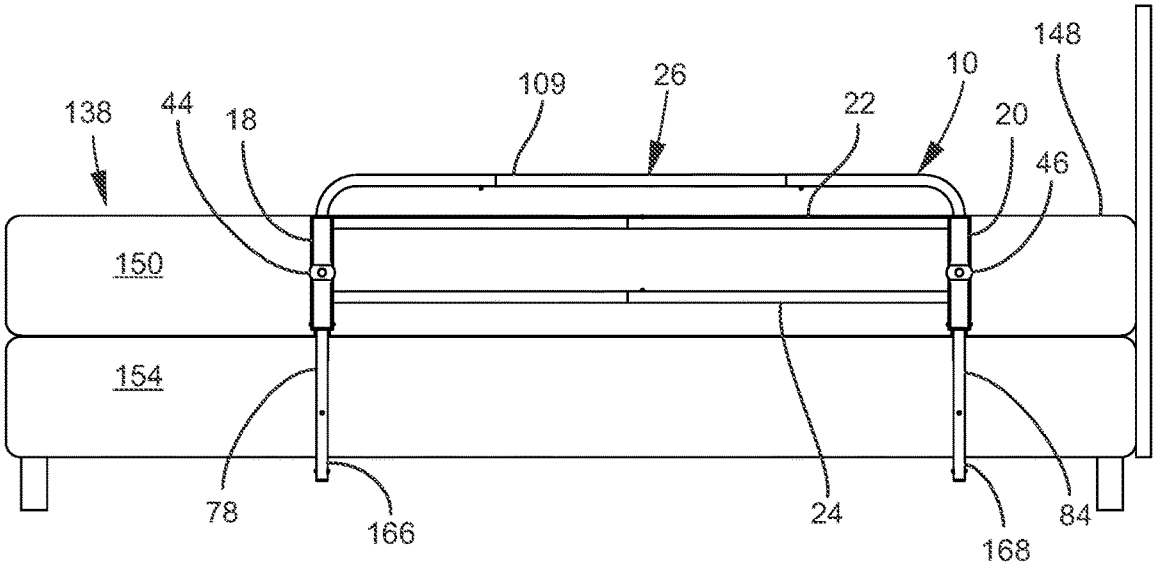
FIG. 3B is an elevation view of the pull up push down bed rail and bed of FIG. 3A in the pushed down position.

FIG. 3A shows the pulled up position of the U-shaped support member 26 and FIG. 3B shows the pushed down position of the U-shaped support member 26. FIGS. 3A and 3B show that the upper cross member 22 is adjacent to and parallel to the plane of the sleeping surface 148. Upper cross member 22 is parallel to lower cross member 24 and to the top cross member 109 of the U-shaped frame member 26. End members 78, 84 extend at right angles relative to cross members 22, 24, and 109. First and second bases 18, 20 and axis of through openings 28, 30 extend at right angles relative to cross members 22, 24, and 109.

Figure 4A:
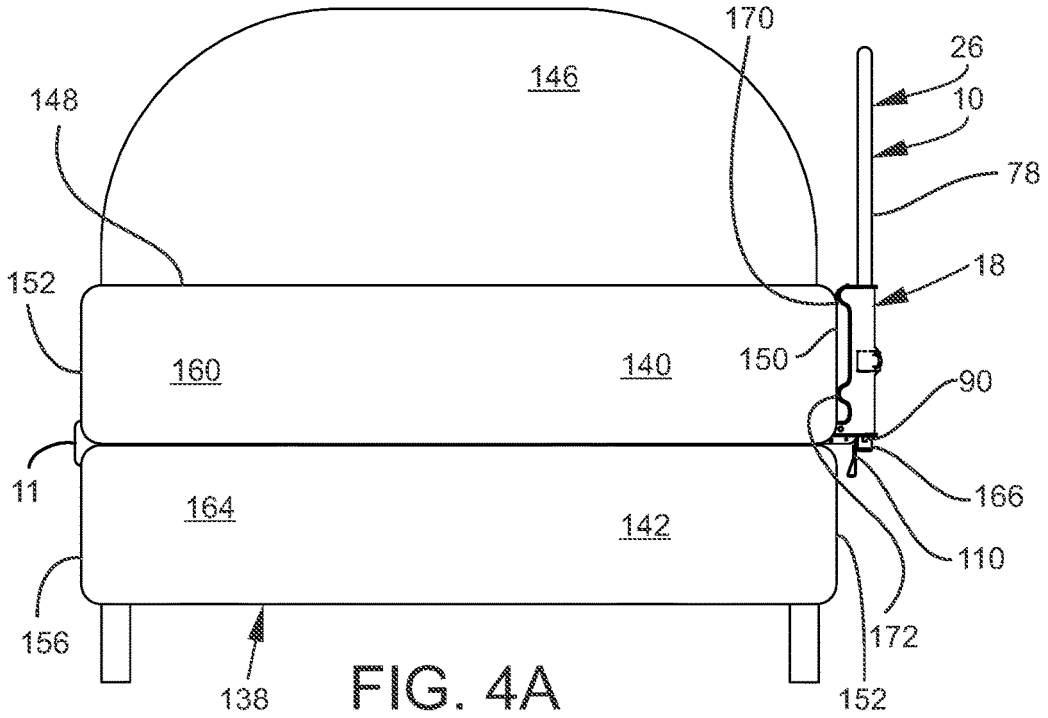
FIG. 4A is a side view of the pull up push down bed rail and bed of FIG. 2A in the pulled up position.
Figure 4B:
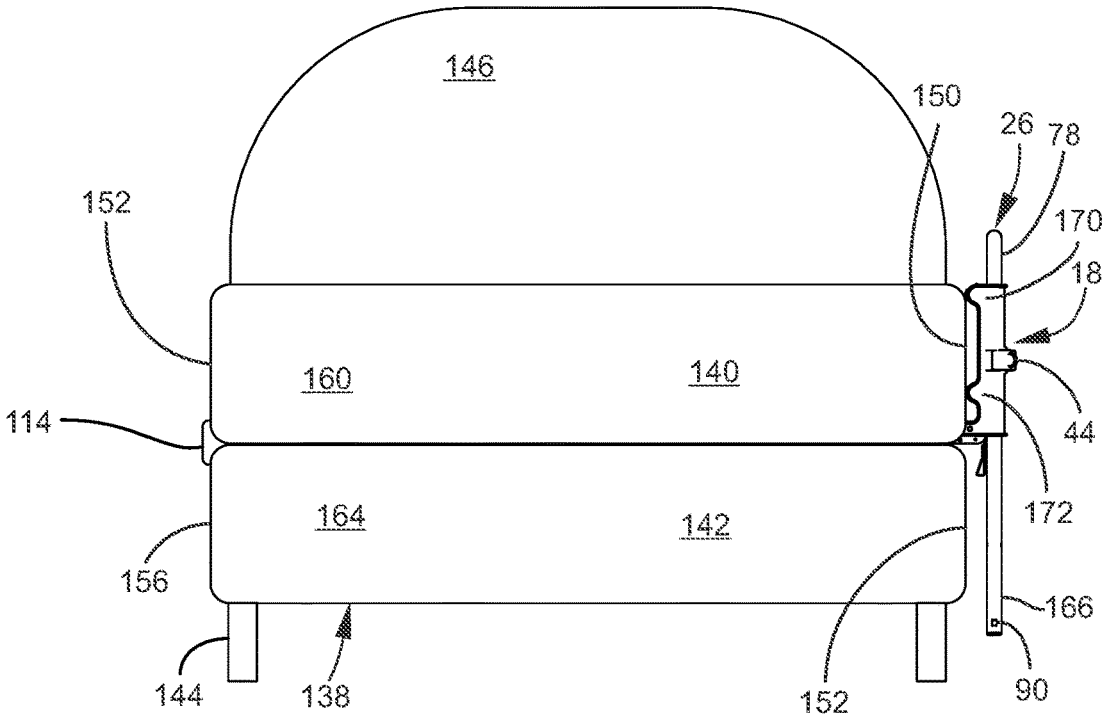
FIG. 4B is a side view of the pull up push down bed rail and bed of FIG. 3A in the pushed down position.
Figure 14A:
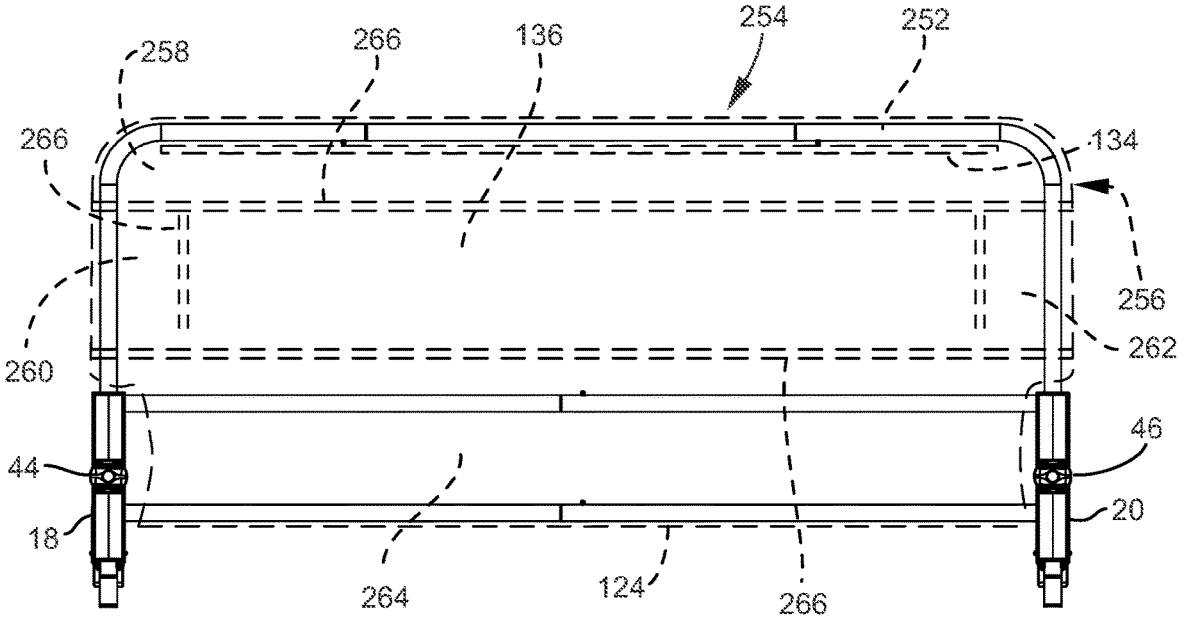
FIG. 14A is a front view of the frame of the bed rail of FIG. 1 with a different sheeting embodiment shown in phantom, where the sheeting is extended and the bed rail is in the pulled up position.
Figure 14B:
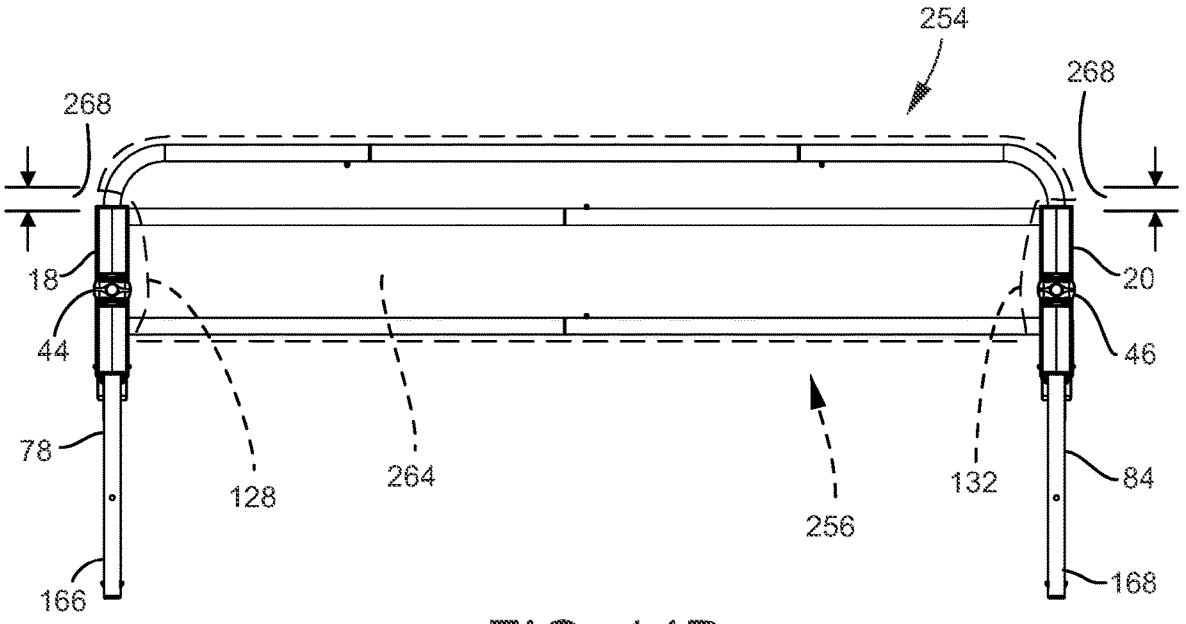
FIG. 14B is a front view of the frame of the bed rail of FIG. 1 with the sheeting embodiment of FIG. 14A shown in phantom, where the sheeting is scrunched down and the bed rail is in the pushed down position.

FIGS. 4A and 4B show that first base 18 includes upper and lower projections or extensions 170, 172 that extend rearwardly so as to confront the mattress near side 150, or dig into the mattress near side 150, or extend up to the mattress near side 150, or extend into the mattress near side 150. Second base 20 also includes these upper and lower projections and extensions. Upper and lower projections form seats or receptors for engaging the outer ends of the upper and lower cross members 22, 24. Distal ends or far ends or rear ends of the four extensions 170, 172 define a plane that is immediately adjacent to the plane defined by the near sides 150, 152 of the mattress 140 and mattress support 142 so as to place the upper and lower cross members 22, 24 also immediately adjacent to the near sides 150, 152 and the plane defined thereby. Sheeting 14 is not present between the bases 18, 20 and the near sides 150, 152, as indicated by FIGS. 14A and 14B. The plane defined by U-shaped frame member 26 and the through openings 28, 30 of the first and second bases 18, 20 is parallel to and adjacent to the plane defined by the near sides 150, 152 and is further parallel to and adjacent to the plane defined by the axis of the upper and lower cross members 22, 24. Three planes are present. From front to rear, the planes are 1) the plane defined by the U-shaped frame member 26 and the axis of the through openings 28, 30, 2) the plane defined by the axis of the upper and lower cross members 22, 24, and 3) the plane defined by the near sides 150, 15 and distal ends of the extensions 170, 172. All three planes are adjacent to each other and parallel to each other.

FIGS. 4A, 4B further show the counter member 166 of the counter member arrangement 16. Counter member 166 engages each of the far side 152 of mattress 140 and the far side of the mattress support 142. Straps 110, 112 extend between the mattress 140 and mattress support 142, namely between the upper side of the mattress support 142 and the lower side of the mattress 140. Extensions 170, 172 and bases 18, 20 as a whole act as a counter member that opposes counter members 114, 116, where base 18 opposes counter member 114 and where base 20 opposes counter member 116. By retracting the stops 90, 92 and the locks of lock apparatus 44, 46, U-shaped frame member 26 may be pulled up from the pulled up position of FIGS. 2A, 3A, and 4A such that lower ends 166, 168 of end members 78 84 are lifted into the through openings 28, 30. Then straps 110, 112 may be tightened by pulling on the proximal ends of the straps 110, 112 such that the counter members 114, 116 and bases 18, 20 hug the mattress 140 more tightly. However, the proximal ends of straps 110, 112 may be accessed and pulled by the caretaker for tightening even when the U-shaped frame member 26 is in the pulled up position, pushed down position, or at any position therebetween.

Figure 5A:
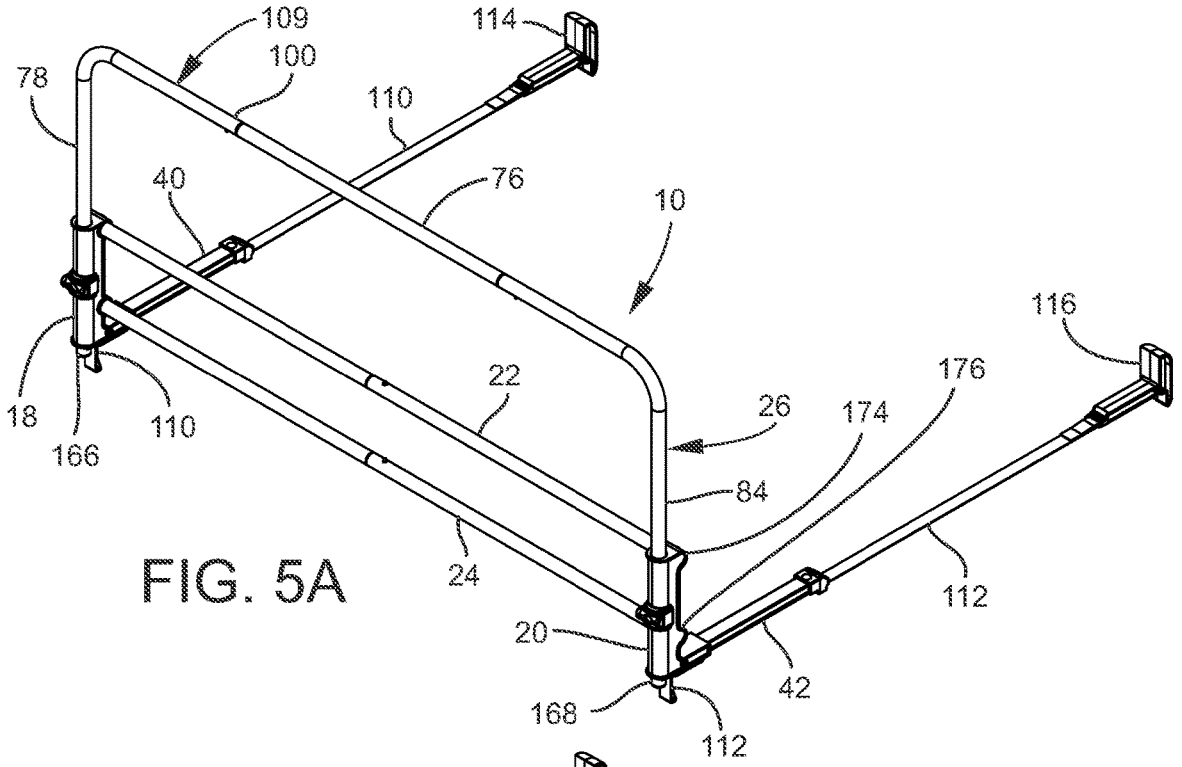
FIG. 5A is a perspective isolated view of the pull up push down bed rail of FIG. 1 in the pulled up position.
Figure 5B:
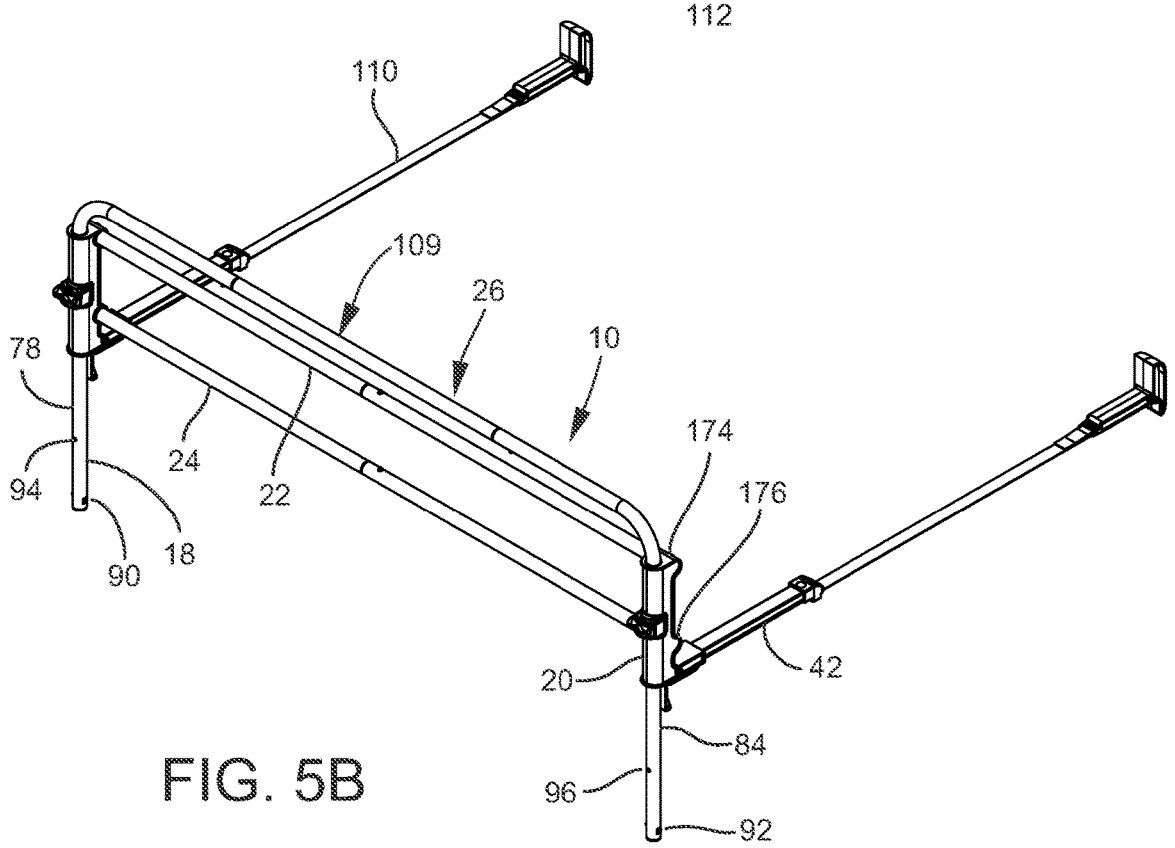
FIG. 5B is a perspective isolated view of the pull up push down bed rail of FIG. 1 in the pushed down position.
Figure 6A:
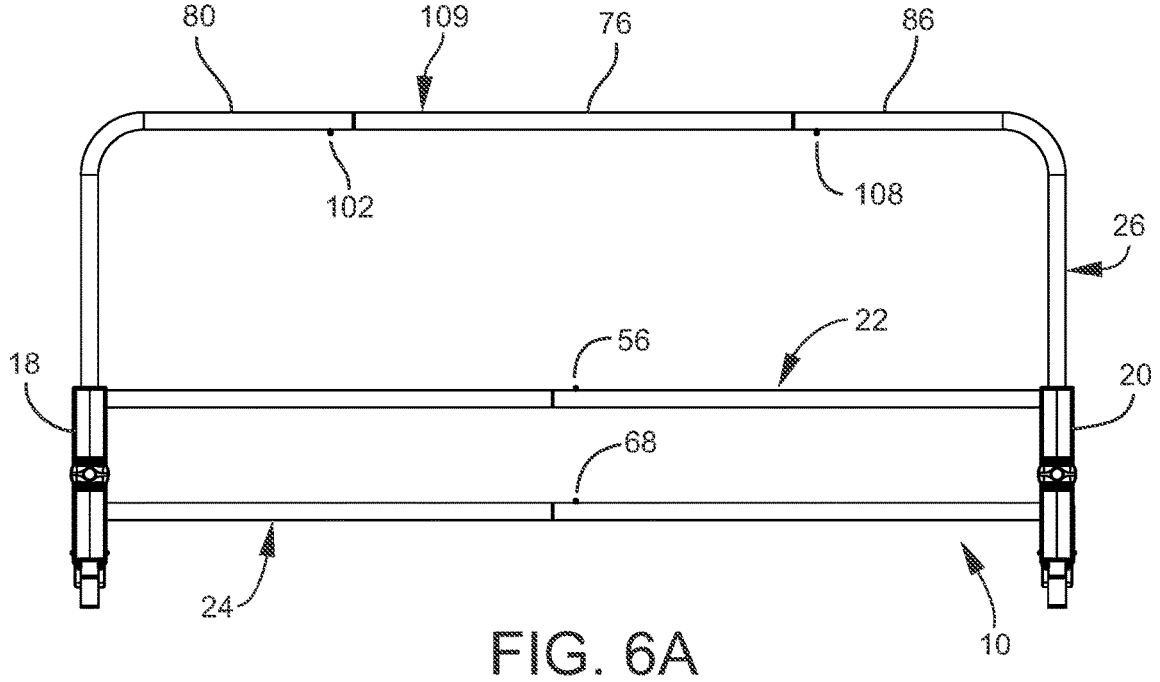
FIG. 6A is an elevation isolated view of the pull up push down bed rail of FIG. 1 in the pulled up position.
Figure 6B:
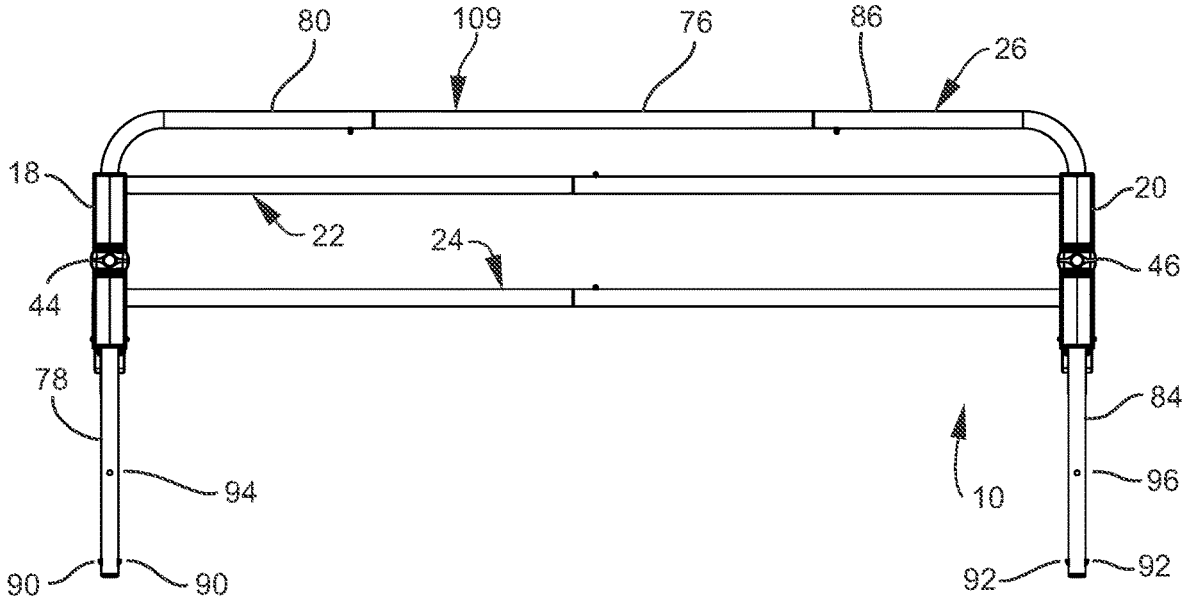
FIG. 6B is an elevation isolated view of the pull up push down bed rail of FIG. 1 in the pushed down position.

FIGS. 5A, 5B, 6A, and 6B show the bed rail 10 in greater detail. Further, these FIGS. 5A, 5B, 6A, and 6B show bed rail 10 in an assembled form, relative to FIG. 1 that shows the bed rail 10 in a disassembled form. FIGS. 5A and 5B show the upper and lower extensions 174, 176 of base 20.

Figure 7A:
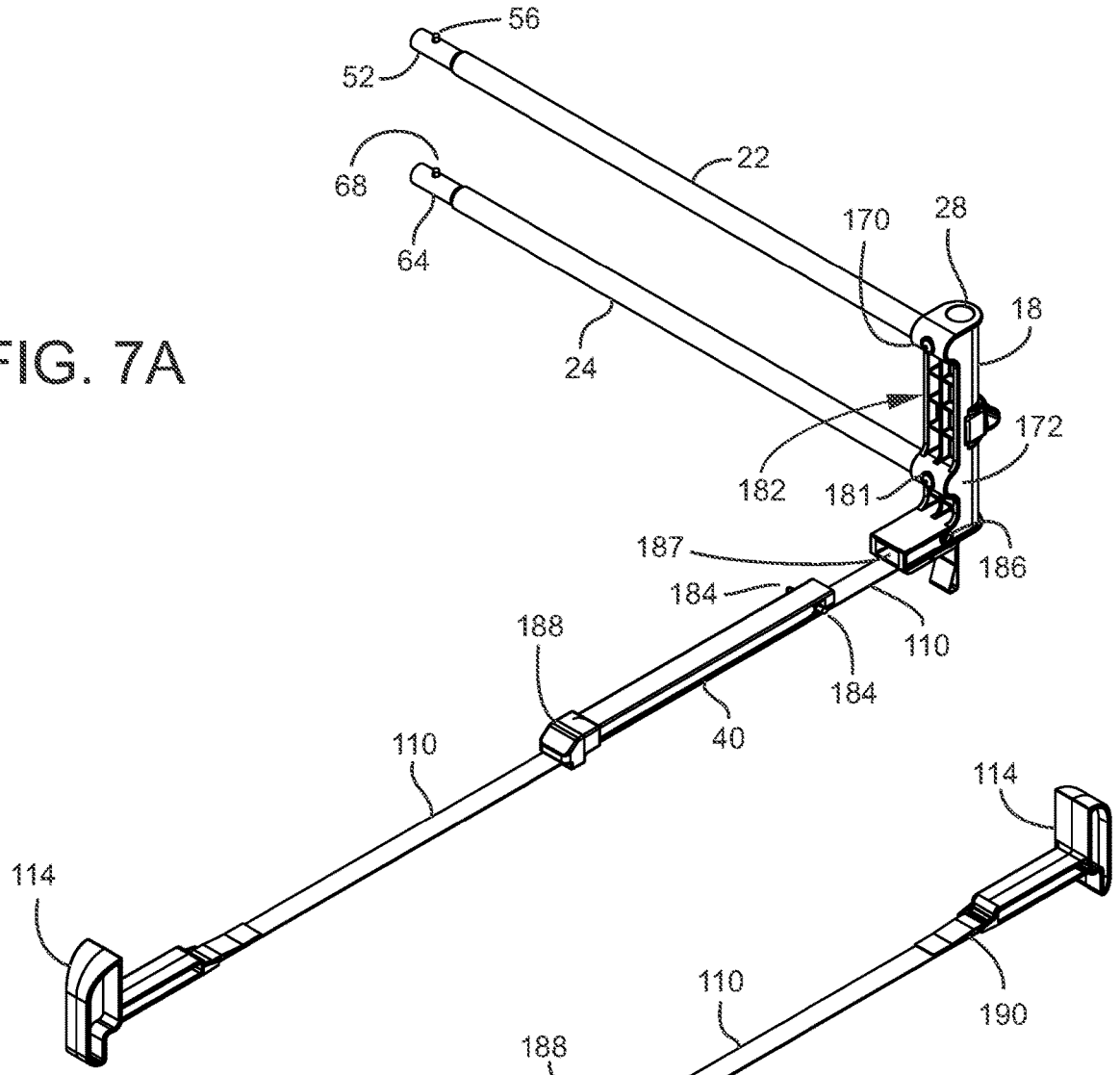
FIG. 7A is a perspective view of a portion of the rear side of the bed rail of FIG. 1.
Figure 7B:
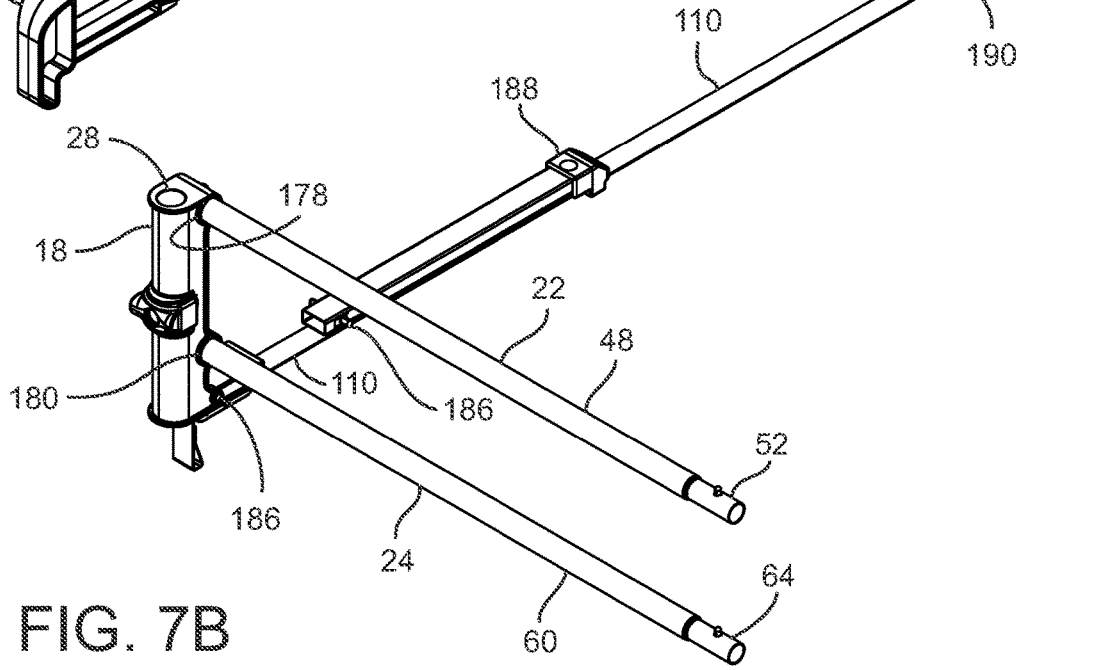
FIG. 7B is a perspective view of a portion of the front side of the bed rail of FIG. 1.

FIG. 7A shows a portion of a rear side of the bed rail 10 and FIG. 7B shows a portion of the front side of the bed rail 10. FIGS. 7A, 7B show that extensions 170, 172 form seats 178, 180 for the outer ends of the cross support members 22, 24. Outer ends of the cross support members 22, 24 are rigidly fixed such as by rivets 181 to base 18 such that cross support members 22, 24 cannot be removed therefrom without destroying the integrity of the members 22, 24 or base 18. This structure is also found as to the other outer ends of cross support members 22, 24 and base 20. A ribbed structure 182 is disposed in base 18 between upper and lower extensions 170, 172. This ribbed structure is also found in base 20. The proximal end of tube 40 of the counter member arrangement 16 includes a pair of opposing spring biased pins 184 that engage holes or pin receptors 186 in the horizontal portion 36 of base 18 that includes a receiver 187 for the tube 40. The distal end of tube 40 includes a cap 188 that includes a slot for receiving strap 110. The distal end of strap 110 forms a loop 190 that engages a horizontal post of counter member 114 in a stitched permanent fashion.

Figure 8A:
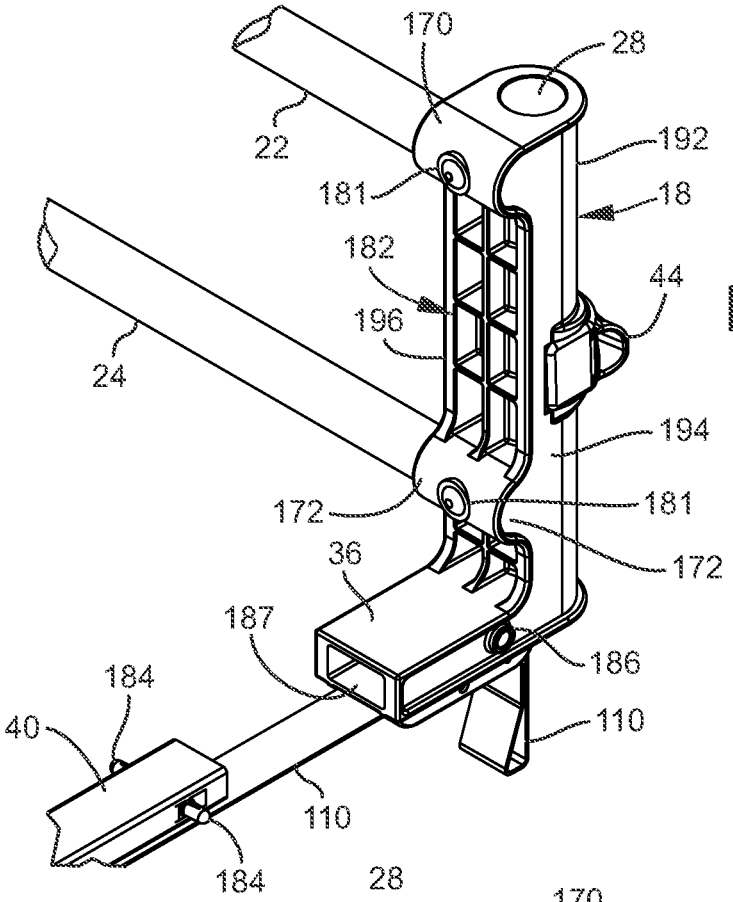
FIG. 8A is a perspective detail view of a portion of the rear side of the bed rail of FIG. 1.
Figure 8B:
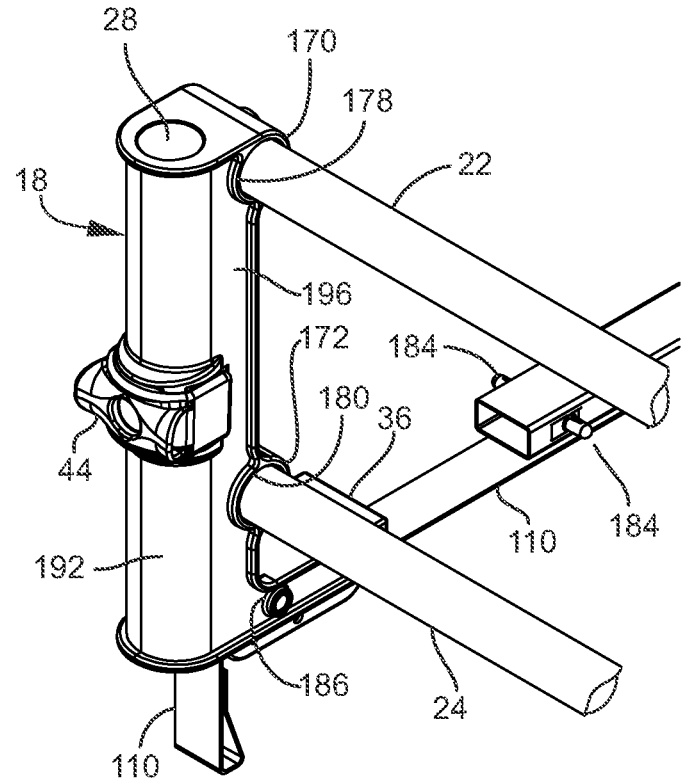
FIG. 8B is a perspective detail view of a portion of the front side of the bed rail of FIG. 1.

FIGS. 8A and 8B show rear and front views of base 18 and show that base 18 includes a vertically extending cylindrical portion 192, a vertically running outer sidewall 194, and a vertically running inner sidewall 196. Sidewalls are spaced apart and parallel to each other and include the rib structure 182 therebetween. Sidewalls 194, 196 extend horizontally into the cylindrical portion 192. Cylindrical portion 192 forms the through opening 28, having a cylindrical inner wall, that receives end member 78 of U-shaped frame member 26. Rib structure 182 is integral with and extends to each of the cylindrical portion 192, vertical sidewall 194, and vertical sidewall 196. Rib structure 182 runs vertically from horizontal piece 36, to lower extension 172 to upper extension 170 on first base 18, with an equivalent structure found on second base 20.

Figure 9B:
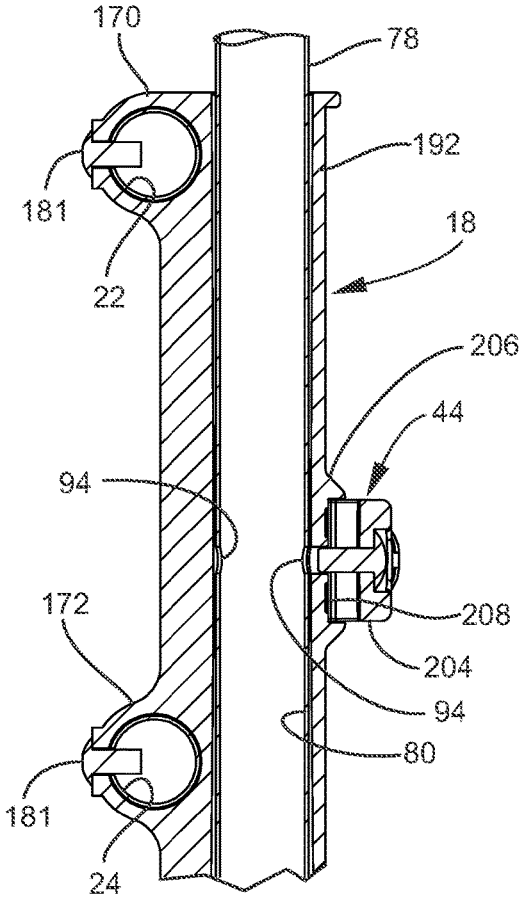
FIG. 9B is a view of a portion of FIG. 9A showing the bed rail lock in an open or unlocked position.
Figure 9A:
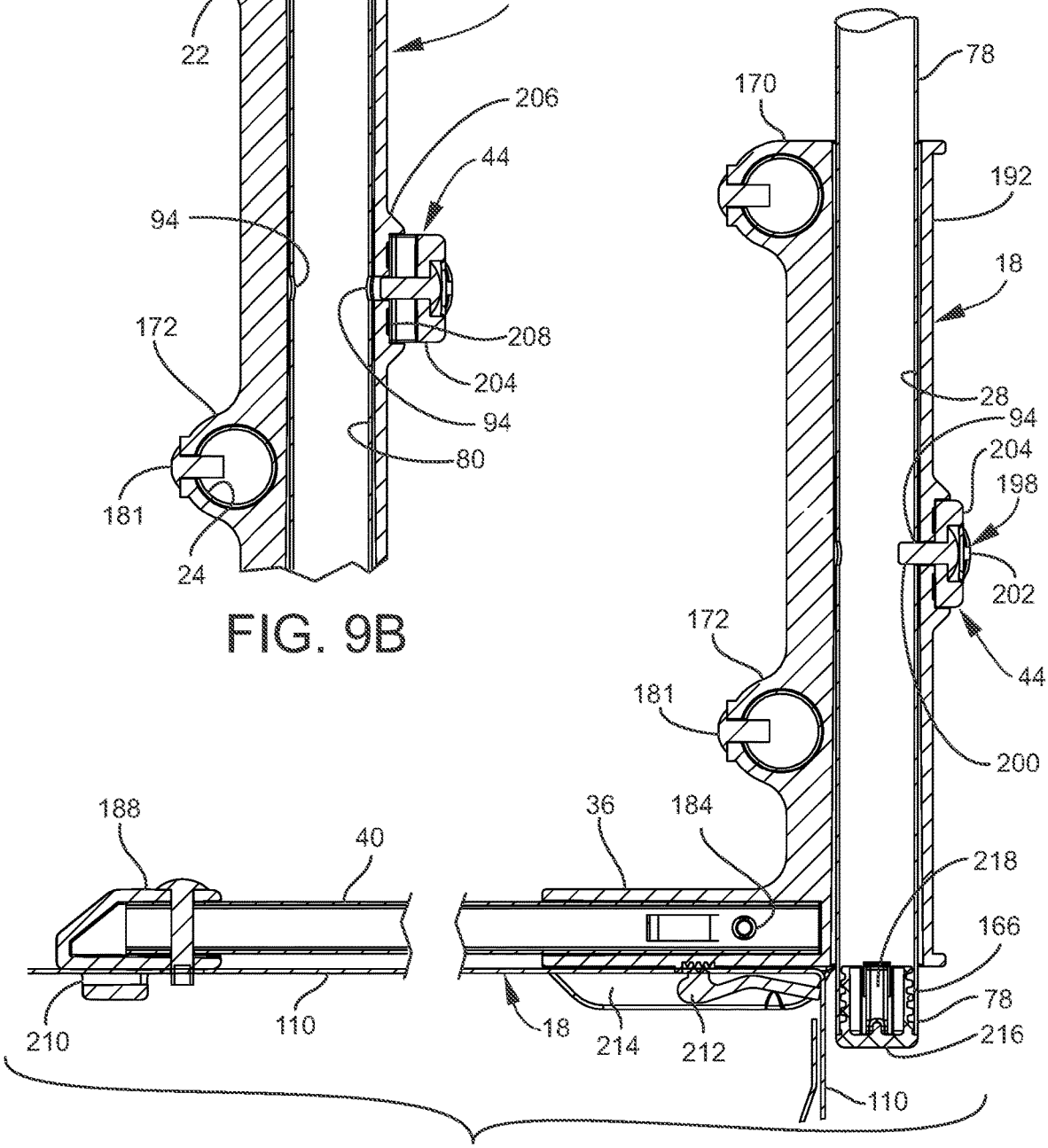
FIG. 9A is a side section partially exploded view of a portion of the bed rail of FIG. 1 showing a bed rail lock in a closed or locked position.

FIG. 9A shows the lock apparatus 44 engaged with the end member 78. Lock apparatus 44 includes a pin 198. Pin 198 includes a shaft 200 and a head 202. In the pulled up position of the U-shaped frame member 26, shaft 200 extends through opening 94 of the end member 78 to lock the U-shaped frame member 26 to the pulled up position. Pin head 202 is rigidly set in a U-shaped piece 204. U-shaped piece 204 snappingly engages a receptor 206 having an interior 208 for snappingly receiving piece 204. U-shaped piece 204 is preferably formed of plastic and pin 198 is preferably formed of metal. Metal pin 198 engages metal end member 78. Plastic U-shaped piece 204 engages plastic receptor 206, which is a portion of the plastic base 18. Each of the locks 44, 46 has a snapped out position and a snapped in position. Each of the locks 44, 46 remains in its snapped in position until pulled out by the end user to its snapped out position. Each of the locks 44, 46 remains in its snapped out position until pushed in by the end user to the snapped in position. In the snapped in position, the locks 44, 46 lock the end members 78, 84 from sliding axially in bases 18, 20. In the snapped out position, the locks 44, 46 are disengaged from the end members 78, 84 to permit such sliding, if locks 90, 92 also permit such sliding and if the sheeting 14 or 256 is removed (or unzipped if including a zipper) to permit such sliding. If desired, locks 44, 46 may be spring biased locks that automatically lock into the lock holes 94, 96 of the end members 78, 84 as the end members 78, 84 slide axially in the first and second bases, 18, 20, with such spring biased locks being manually pulled out to be disengaged from the end members 78, 84.

FIG. 9B shows the position where pin 198 is disengaged from pin hole 94 such that U-shaped frame member 26 can be withdrawn from bases 18, 20. FIG. 9B further shows that end member 78 has a second opening 94 diametrically opposite of first opening 94 such that first end member 78 can be engaged with second base 20 and such that second end member 84 can be engaged with first base 18. Thus an end user may more quickly assemble bed rail 10. The end user does not have to stop and figure out an exact orientation of the U-shaped frame member 26 relative to bases 18, 20.

FIG. 9A shows portions of the counter member arrangement 18. One portion is the cap 188. Cap 188 includes a slot 210 that engages strap 110. Another portion is a pivoting toothed lock 212 that pivots between open and locked positions. In FIG. 9A, lock 212 is in the locked position where lock 212 pinches strap 110 against an underside of horizontal portion 36 with the teeth of the lock 212. In such position, the counter member 114 and base 18 are restricted or locked from moving further apart from each other. For example, counter member 114 cannot be pulled away from base 18 and base 18 cannot be pulled away from counter member 114 without destroying an integrity of the counter member 114 or base 18. When lock 212, shaped in the form of a tab and pivotally engaged between integral downward opposing extensions 214 that extend downward from horizontal portion 36, is swung 180 degrees opposite of the position shown in FIG. 9A, the strap 110 is released from the pinching engagement, thereby permitting strap 110 to be drawn in to pull counter member 114 closer to base 18 (also a counter member) or to be let out so as to increase the distance between counter member 114 and base 18. The proximal end of each of the straps 110, 112 includes a double layer so as to increase the width or thickness of the strap 110, 112 such that the proximal end cannot pass through the space between lock 212 and the underside of foot 36 or foot 38, without destroying the integrity of the strap 110, 112 or lock 212 or foot 36, 38, such that the counter member arrangements 16 cannot be removed from their respective bases 18, 20. The distal ends of the straps 110, 112 are looped permanently about respective posts of counter members 114, 116 and cannot be removed therefrom without destroying the integrity of the strap 110, 112 or counter member 114, 116. In other words, with the counter member arrangements 16 engaged to the bases 18, 20 at the factory in a permanent fashion, there are less assembly steps for the end user and, further, the chances that the bed rail 10 is set up correctly are maximized.

FIG. 9A further shows that the lower end 166 of end member 78 may include a cap 216 having a slot 218. Slot 218 permits operation of the extensible and retractable pins 90, 92.

Figure 10A:
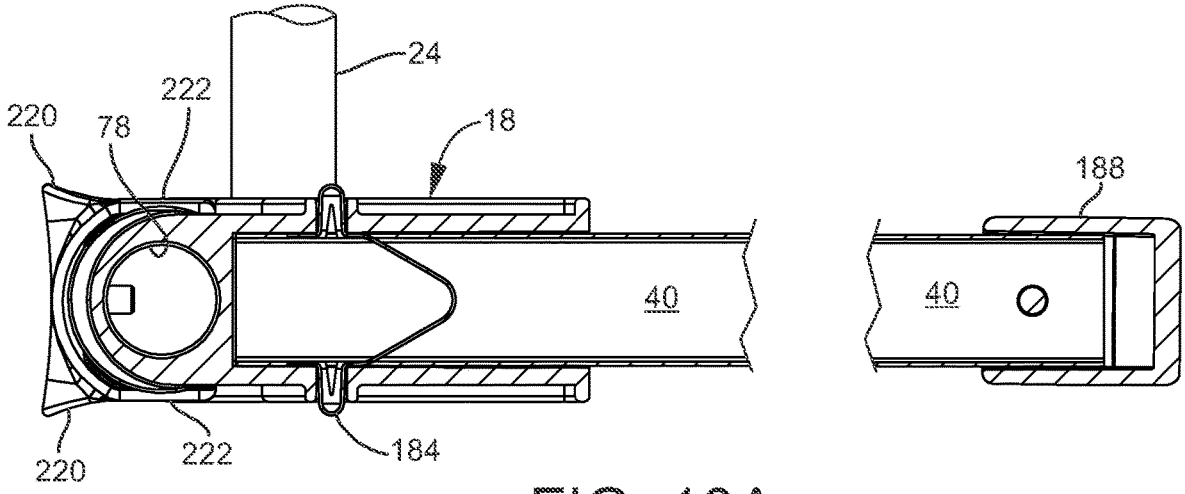
FIG. 10A is a bottom partially exploded view of a portion of the bed rail of FIG. 1.
Figure 10B:
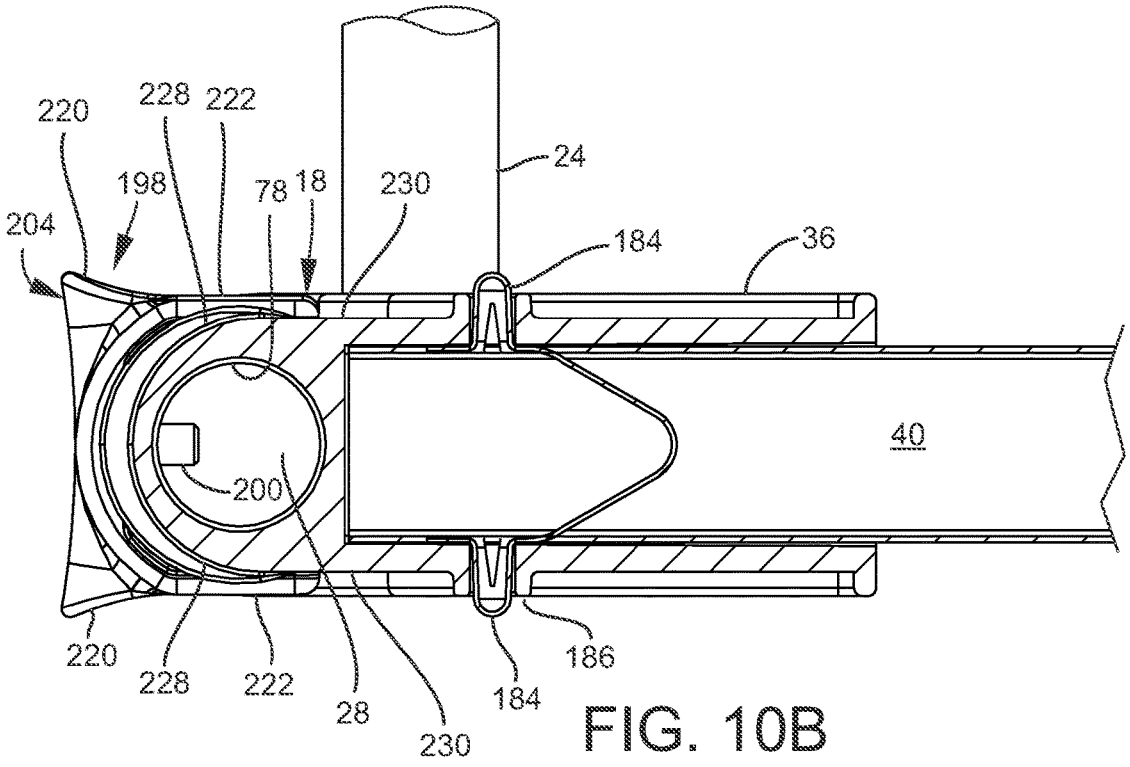
FIG. 10B is a bottom detail view of a portion of FIG. 10A.

FIGS. 10A and 10B show the lock 198 having the U-shaped piece 204. U-shaped piece 204 includes a dovetailed outer finger portion 220 that is readily held or pinched between the thumb and the forefinger by the end user. When pinched and drawing the U-shaped piece 204 out along a right angle to the axis of end member 78, side portions 222 of the U-shaped piece 204 resiliently unsnap from an interior 208 of receptor 206. Interior 208 of receptor 206 and inner faces of side portions 222 of U-shaped piece 204 have opposing stops 224, 226, shown in FIG. 11A, that prevent the U-shaped piece 204 from disengaging completely from base 18 after lock 44 is unsnapped. Stop 224 is on the inner face of side portion 222 and stop 226 is on interior 208 of receptor 206. Stops 224, 226 are separated from each other at least by the distance that pin shaft 200 extends into opening 28 such that the distal end of pin shaft 200 is withdrawn outwardly beyond of the outer diameter of end member 78 such that the end member 78 can slide axially in opening 28. U-shaped portion 228 is disposed on the cylindrical portion 192 of base 18. U-shaped portion 228 includes distal ends that are wider than opposing sidewall portions 230 and such distal ends terminate at the sidewall portions 230. The distal ends of sidewalls 222 resiliently snap over and back over the junction between the distal ends of U-shaped portion 228 and sidewall portions 230.

Figure 11A:
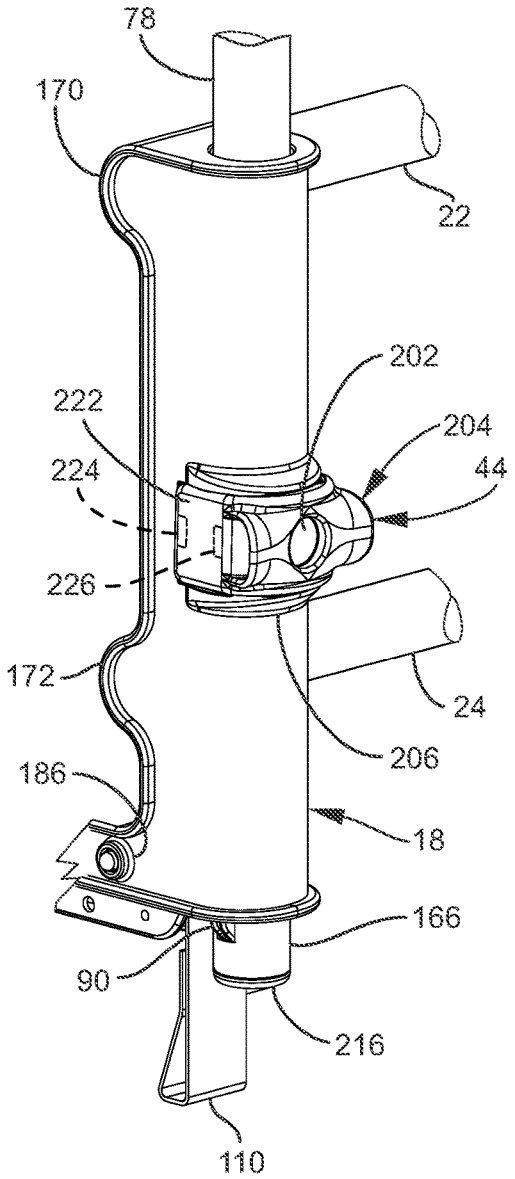
FIG. 11A is a perspective detail view of one of the bases of the pull up push down bed rail of FIG. 1.
Figure 11B:
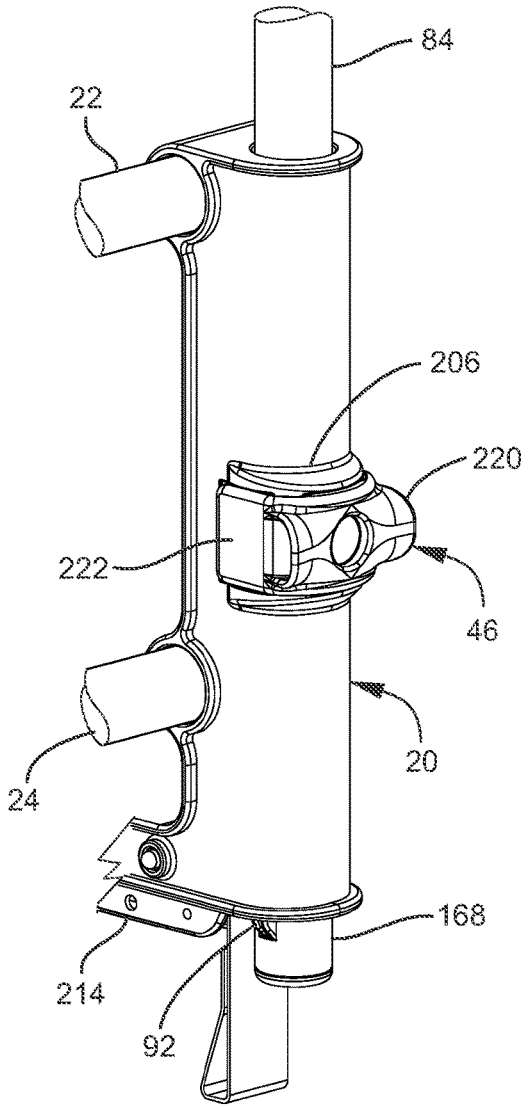
FIG. 11B is a perspective detail view of the other of the bases of the pull up push down bed rail of FIG. 1.

FIGS. 11A and 11B show the lower ends 166, 168 of the end members 78, 84 extending beyond the lower open ends of the through openings 28, 30 when the U-shaped frame member 26 is in the pulled up position, in which position the U-shaped frame member 26 is locked to the bases 18, 20. In such a position, pins 90, 92 act as secondary or insurance locks and are extended such that end members 78, 84 cannot be pulled up out of the through openings 28, 30.

Figure 12A:
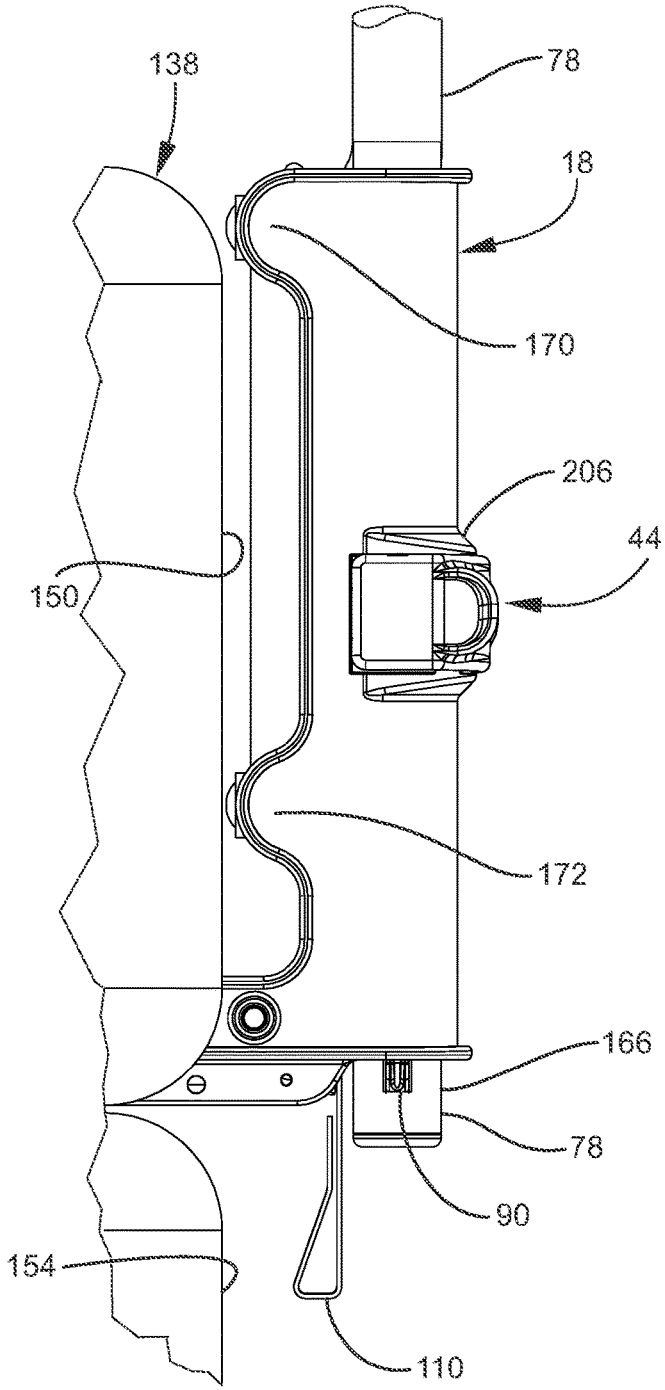
FIG. 12A is a side detail view of the base of FIG. 11A.
Figure 12B:
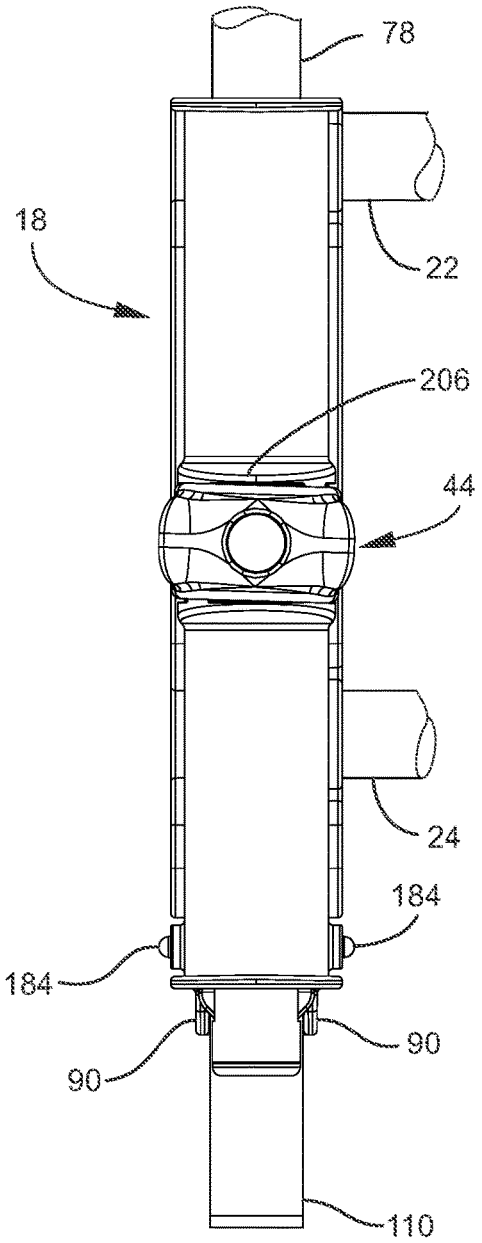
FIG. 12B is a front detail view of the base of FIG. 12A.

FIG. 12A shows that extensions 170, 172 are disposed adjacent to the near side 150 of the bed 138 when the bed rail 10 is in the operating position, i.e., when the U-shaped frame member 26 is in the pulled up position. Extensions 170, 172 are also disposed adjacent to the near side 150 of the bed 138 when the U-shaped frame member 26 is in the pushed down position. FIG. 12B shows that pins 90 extend diametrically opposite of each other. Pins 90 in the extended position confront an underside of base 18 when U-shaped frame member 26 is in the pulled up position. Strap 110 may be tightened or loosened when the U-shaped frame member 26 is in the pulled up position, the pushed down position, at any position in between, or when the U-shaped frame member 26 is disengaged from the bases 18, 20.

Figure 13A:
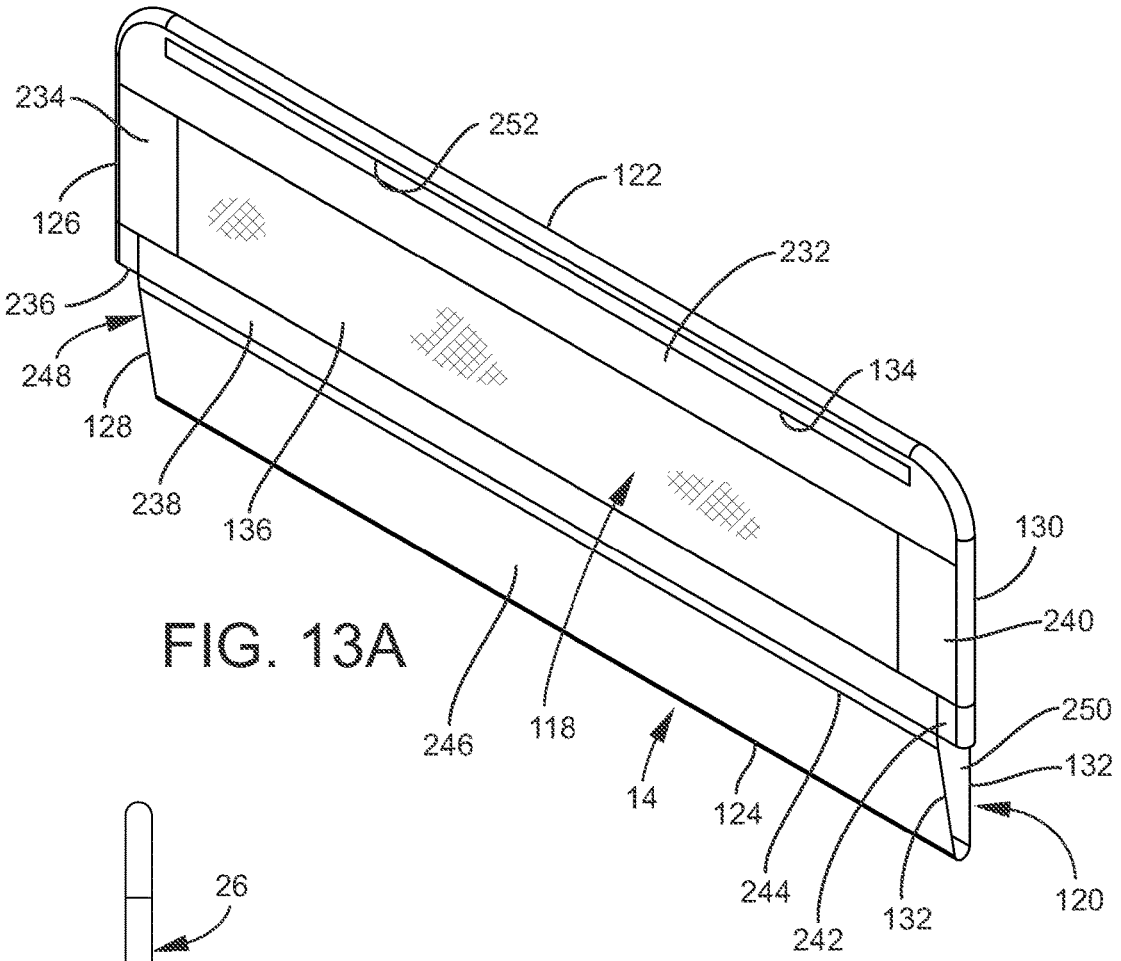
FIG. 13A is a perspective detail view of the sheeting portion of the pull up push down bed rail of FIG. 1.

FIG. 13A shows sheeting 14. Sheeting 14 has been described above with respect to FIG. 1 and is further described here with the larger view that FIG. 13A provides.

Front sheet portion 118 includes an upper sheet panel 232 bounded by, and engaged to such as by stitching, the top edge portion 122, the first upper end sheet portion 126, the second upper end sheet portion 130, and the mesh sheet panel 136.

Front sheet portion 118 further includes a first intermediate end sheet panel 234 bounded by, and engaged to such as by stitching, upper sheet panel 232, first upper end sheet portion 126, mesh sheet panel 136, an intermediate end sheet panel 236, and a middle sheet panel 238.

Front sheet portion 118 further includes a second intermediate end sheet panel 240 bounded by, and engaged to such as by stitching, upper sheet panel 232, second upper end sheet portion 130, mesh sheet panel 136, an intermediate end sheet panel 242, and middle sheet panel 238.

Front sheet portion 118 further includes an end to end middle sheet panel 244 bounded by, and engaged to such as by stitching, middle panel 238, a lower sheet panel 246, and the front lower end portions 128, 132. Lower sheet panel 246 is bounded by, and engaged to such as by stitching, the front lower end portion 128, the front lower end portion 132, the bottom edge portion 124, and the middle sheet panel 244.

Rear sheet portion 120 of sheeting 14 is identical to the front sheet portion 118.

The first lower end portions 128 of the sheeting 14 are spaced from each other to create an opening 248 into sheeting 14 and a space for the first base 18. The second lower end portions 132 of the sheeting 14 are spaced from each other to create an opening 250 into the sheeting 14 and a space for the second base 20.

Sheeting 14 includes a front sheet portion 118, a rear sheet portion 120, a top edge portion 122, a bottom edge portion 124, a first upper end portion 126, a pair of first lower end portions 128, a second upper end portion 130, and a pair of second lower end portions 132. The front sheet portion 118 is spaced from the rear sheet portion 120 by the top edge portion 122, the bottom edge portion 124, the first upper end portion 126, and the second upper end portion 130. The top edge portion 122 of the sheeting 14 engages the cross portion 109 of the U-shaped support member 26. The bottom edge portion 124 of the sheeting 14 engages the lower cross support member 24. The first upper end portion 126 of the sheeting 14 engages the first end portion 78 of the U-shaped support member 26. The second upper end portion 130 of the sheeting 14 engages the second end portion 84 of the U-shaped support member 26. The first lower end portions 128 of the sheeting 14 are spaced from each other to create a space for the first base 18. The second lower end portions 132 of the sheeting 14 are spaced from each other to create a space for the second base 20. Such a structure for sheeting 14 provides that the cross portion 109 of the U-shaped support member 26 is inside of the sheeting 14, provides that sections of the first and second end portions 78, 84 of the U-shaped support member 26 are inside of the sheeting 14, with other sections of the first and second end portions 78, 84 of the U-shaped support member 26 being in the first and second bases 18, 20, provides that each of the upper and lower cross support members 22, 24 are inside of the sheeting 14, and provides that each of the first and second bases 18, 20 are outside of the sheeting 14. Sheeting 14 further includes a top quick connect strip 134 on the front sheet portion 118 and an opposing quick connect strip on the rear sheet portion 120 of the sheeting 14. Inner faces of such top quick connect flexible strips engage each other with hook and loop connectors, such as Velcro® fabric connectors, so as to provide a sleeve, with top edge portion 122, for cross member 109. Sheeting 14 further includes a front rectangular mesh portion 136 engaged to the front sheet portion 118, with the rear sheet portion 120 having an identical mesh portion.

Figure 13B:
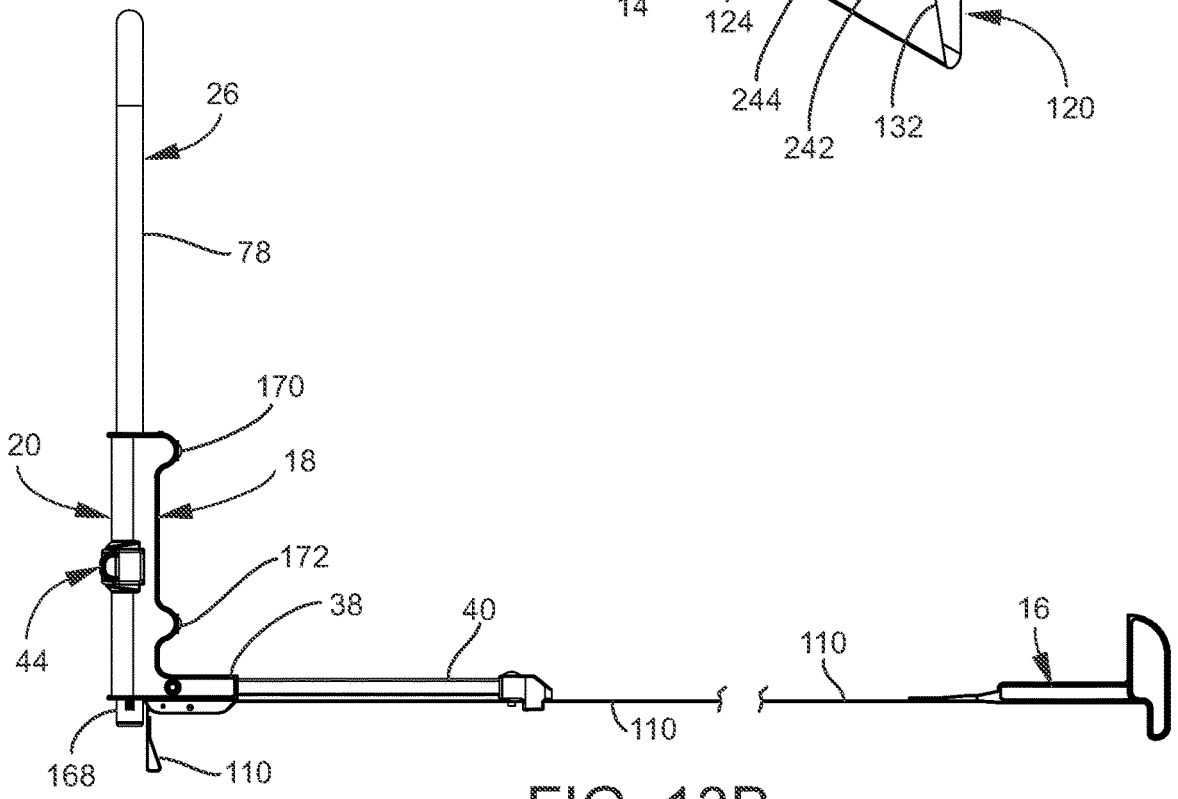
FIG. 13B is a partially exploded end view of the pull up push down bed rail of FIG. 1.

FIG. 13B shows an isolated side view of the bed rail 10. U-shaped frame member 26 is disposed at a right angle to horizontal portion 38 of the base 20 (and base 18) when the U-shaped frame member 26 is in the pulled up position and when the U-shaped frame member 26 is in the pushed down position.

FIGS. 14A and 14B shows a bed rail 254. Bed rail 254 is identical to bed rail 10 except for sheeting 14. Instead of sheeting 14, bed rail 254 includes sheeting 256. Sheeting 256 is shown in phantom. Sheeting 256 is identical to sheeting 14 except that sheeting 14 as a whole (front and back) is formed from multiple pieces and sheeting 256 as a whole (front and back) is formed from only four pieces. Sheeting 256 includes a top sheeting portion 258, a left intermediate sheeting portion 260, a right intermediate sheeting portion 262, and a bottom sheeting portion 264. Top portion 258 in three dimensions forms the shape of an inverted channel having closed ends in the nature of an inverted trough or feed bin. Left intermediate portion 260 in three dimensions is U-shaped. Right intermediate portion 262 in three dimensions is U-shaped. Bottom portion 264 in three dimensions includes an open top and open ends and is U-shaped. Junctions between portions 258, 260, 262, 264, and mesh portion 136 are stitched and reinforced with strips 266 of flexible material or fabric. Top sheeting portion 258 is engaged to mesh portion 136 and to intermediate sheeting portions 260, 262. Bottom sheeting portion 264 is engaged to mesh portion 136 and to intermediate sheeting portions 260, 262. Mesh portion 136 is engaged to top sheeting portion 258, bottom sheeting portion 264, left intermediate sheeting portion 260, and right intermediate sheeting portion 262. It should be noted that there is a front mesh portion 136 and a rear mesh portion 136. Left intermediate sheeting portion 260 is engaged to top sheeting portion 258, mesh portion 136, and bottom sheeting portion 264. Right intermediate sheeting portion 262 is engaged to top sheeting portion 258, mesh portion 136, and bottom sheeting portion 264.

FIG. 14B shows area 268. Area 268 refers to the portion of sheeting 256 (or sheeting 14) that is scrunched down when the U-shaped frame member 26 is in the pushed down position. In the pushed down position, only a small horizontal strip of bottom portion 264 scrunches down. In the pushed down position all of sheeting portions 260, 262 and all of mesh portion 136 scrunches down. Most of top sheeting portion 258 scrunches down. The section of top portion 258 having sleeve 252 and quick connect strip 134 does not scrunch down.

It should be noted that sheeting 14 and 256 act as a lock against the U-shaped frame member 26 from being pulled out of the bases 18, 20 from the pulled up position. In other words, even if locks 90, 92, 44, and 46 are retracted and attempt is made to pull up on the U-shaped frame member 26, bottom edge portion 124 of the sheeting 14 or 256 prevents such an attempt.

It should be noted that, if desired, sheeting 14 or 256 may have a zipper running completely along bottom edge portion 124 so as to make it easy for the sheeting 14 or 256 to come off and such that the frame 12 does not need to be assembled within the sheeting 14 or 256. In such a case, the sheeting 14 or 256 having such a zipper is engaged and disengaged from the frame 12 when the U-shaped frame member 26 is in the pushed down position. After such a zippered sheeting is engaged, quick connect strips 134 are engaged to each other and then the zipper is closed so as to engage sheeting 14 or 256 to the frame 12.

From a review of FIGS. 2A, 2B, 3A, 3B, 4A, 5A, 5B, 6A, and 6B, the following features are appreciated:

1) in the pulled up position, a section of the first end portion 78 of the U-shaped support member 26 is disposed adjacent to the uppermost portion of the through opening 28 of the first base 18;

2) in the pulled up position, a section of the second end portion 84 of the U-shaped support member 26 is disposed adjacent to the uppermost portion of the through opening 30 of the second base 20;

3) in the pulled up position, a section of the first end portion 78 of the U-shaped support member 26 is disposed adjacent to the lowermost portion of the through opening 28 of the first base 18;

4) in the pulled up position, a section of the second end portion 84 of the U-shaped support member 26 is disposed adjacent to the lowermost portion of the through opening 30 of the second base 20;

5) in the pushed down position, a section of the first end portion 78 of the U-shaped support member 26 is disposed adjacent to the uppermost portion of the through opening 28 of the first base 18;

6) in the pushed down position, a section of the second end portion 84 of the U-shaped support member 26 is disposed adjacent to the uppermost portion of the through opening 30 of the second base 18;

7) in the pushed down position, a section of the first end portion 78 of the U-shaped support member 26 is disposed adjacent to the lowermost portion of the through opening 28 of the first base 18;

8) in the pushed down position, a section of the second end portion 84 of the U-shaped support member 26 is disposed adjacent to the lowermost portion of the through opening 30 of the second base 20;

9) in the pulled up position, a section of the first end portion 78 of the U-shaped support member 26 is disposed adjacent to and lower than the lowermost portion of the through opening 28 of the first base 18, and, in the pulled up position, a section of the second end portion 84 of the U-shaped support member 26 is disposed adjacent to and lower than the lowermost portion of the through opening 30 of the second base 20; and 10) in the pushed down position, a section of the first end portion 78 of the U-shaped support member 26 is spaced apart from and disposed lower than the lowermost portion of the through opening 28 of the first base 18, and, in the pushed down position, a section of the second end portion 84 of the U-shaped support member is spaced apart from and disposed lower than the lowermost portion of the through opening 30 of the second base 20.

The first end portion 78 of the U-shaped support member 26 includes a first stop 90 extending from the first end portion 78 and engaging a portion of the first base 18 when the first end portion 78 slides axially upwardly. The first stop 90 is disposed adjacent to and lower than the lowermost portion of the through opening 28 of the first base 18 when the U-shaped support member 26 is in the pulled up position. The second end portion 84 of the U-shaped support member 26 includes a second stop 92 extending from the second end portion 84 and engaging a portion of the second base 18 when the second end portion 84 slides axially upwardly. The second stop 92 is disposed adjacent to and lower than the lowermost portion of the through opening 30 of the second base 20 when U-shaped support member 26 is in the pulled up position.

Each of the first and second stops 90, 92 is retractable to reduce a width of the first and second end portions 78, 84, respectively, such that first and second end portions 78, 84 are pullable up through and out of the through openings 28, 30 such that the U-shaped support member 26 is pullable up and out of the first and second bases 18, 20 when locks 44, 46 are also retracted and disengaged from the first and second end portions 78, 84.

From a review of FIGS. 2A, 2B, 3A, 3B, 4A, 5A, 5B, 6A, and 6B, the following features of the bed rail 10 can be appreciated:

a) the U-shaped support member 26 is slideable between the pulled up position where locks 44, 46 are locked to the U-shaped frame member 26 and the pushed down position where curved transition tube sections 82, 88 prevent the U-shaped member 26 from being further pushed in the downward direction;

b) the U-shaped support member 26 is not slideable lower than the pushed down position, without destroying an integrity of the pull up push down bed rail, because of the transition support members 82, 88;

c) in the pushed down position, the U-shaped support member 26 is not locked to the first and second bases 18, 20 because locks 44, 46 are not engaged;

c) from the pushed down position, the U-shaped support member 26 is slideable upwardly freely immediately;

d) from the pushed down position, the U-shaped support member 26 is pullable up to the pulled up position where the U-shaped support member 26 is lockable in the pulled up position to the first and second bases 18, 20;

e) from the pulled up position, the U-shaped support member is pushable down only after being unlocked from the first and second bases 18, 20 by the locks 44, 46; and f) from the pulled up position, the U-shaped support member 26 is pullable up and out of the first and second bases 18, 20 only when being unlocked from the first and second bases 18, 20 by the locks 44, 46 and further only when the first and second stops 90, 92 disposed on the first and second end members 78, 84, respectively, are retracted.

In the pushed down position, further downward travel of the U-shaped support member 26 is prevented by a) a first junction 82 between the first end portion 78 and the first cross support member 109, and b) a second junction 88 between the second end portion 84 and the first cross support member 109. A distance between the first and second junctions 82, 88 is less than a distance between an axis of the through opening 28 of the first base 18 and an axis of the through opening 30 of the second base 20.

It should be noted that first end portion 78 includes a first bottommost section 166, that the second end portion 84 includes a second bottommost section 168, that the first end portion 78 includes a first stop 90 adjacent to the first bottommost section 166, that the second end portion 84 includes a second stop 92 adjacent to the second bottommost section 168, that the first stop 90 and first end portion 78 include an effective width greater than a width of the through opening 28 of the first base 18, that the second stop 92 and second end portion 84 include an effective width greater than a width of the through opening 30 of the second base 20, such that the U-shaped frame member 26 is stopped from sliding upwardly from the pulled up position by the first and second stops 90, 92.

Each of the first and second stops 90, 92 includes a spring biased button pushable into the first and second end portions 78, 84, respectively, such that after the spring biased buttons are pushed in the U-shaped support member 26 may be pulled completely out of the first and second bases 18, 20 when the locks 44, 46 are also retracted.

The pull up push down bed rail 10 includes: a) a first upper stop 44 between the first base 18 and the first end member 78, b) a second upper stop 46 between the second base 20 and the second end member 84, c) the first upper stop 44 being engaged between the first base 18 and the first end member 78 in the pulled up position, the first upper stop 44 being disengaged between the first base 18 and the first end member 78 in the pushed down position, and d) the second upper stop 46 being engaged between the second base 20 and the second end member 84 in the pulled up position, the second upper stop 46 being disengaged between the second base 20 and the second end member 84 in the pushed down position.

The first upper stop 44 is disengagable from one of the first end portion 78 and first base 18 such that the first end portion 78 is pullable up and out of the first base 18. The second upper stop 46 is disengagable from one of the second end portion 84 and second base 20 such that the second end portion 84 is pullable up and out of the second base 18.

The first lower stop 90 extends from the first end portion 78. The first lower stop 90 is adjacent to and lower than the first base 18 in the pulled up position. The first lower stop 90 is spaced from and lower than the first base 18 in the pushed down position. The second lower stop 92 extends from the second end portion 84. The second lower stop 92 is adjacent to and lower than the second base 20 in the pulled up position. The second lower stop 92 is spaced from and lower than the second base 20 in the pushed down position.

Each of the first and second lower stops 90, 92 is retractable into the first and second end members 78, 84, respectively, such that the first and second end members 78, 84 are pullable up and out of the first and second bases 18, 20, respectively, when the locks 44, 46 are unlocked.

The pull up push down bed rail 10 includes a) a first upper stop 44 engaged between the first end portion 78 of the U-shaped support member 26 and the first base 18 when the first end portion 78 is in the pulled up position to stop the first upright portion 78 from sliding in both axial directions in the through opening 28 of the first base 18, b) a second upper stop 46 engaged between the second end portion 84 of the U-shaped support member 26 and the second base 20 when the second end portion 84 is in the pulled up position to stop the second end portion 84 from sliding in both axial directions in the through opening 30 of the second base 20, c) a first lower stop 90 extending from the first end portion 78 of the U-shaped support member 26 and being adjacent to and lower than the first base 18 in the pulled up position, where an effective width of the first end portion 78 and first lower stop 90 is greater than a width of the through opening 28 of the first base 18 to prevent the first end portion 78 from being pulled through the through opening 28 of the first base 18, and d) a second lower stop 92 extending from the second end portion 84 of the U-shaped support member 26 and being adjacent to and lower than the second base 20 in the pulled up position, where an effective width of the second end portion 20 and second lower stop 92 is greater than a width of the through opening 30 of the second base 20 to prevent the second end portion 84 from being pulled through the through opening 30 of the second base 20.

The pull up push down bed rail 10 includes a) first, second, third, and fourth extensions 44, 46, 90, 92, respectively, where the first and third extensions 44, 90 extend either into or from the first end portion 78 of the U-shaped frame member 26, where the second and fourth extensions 46, 92 extend either into or from the second end portion 84 of the U-shaped frame member 26, b) each of the first and third extensions 44, 90 being retractable into either the first end portion 78 or first base 18, each of the second and third extensions 46, 92 being retractable into either the second end portion or second base, and c) the U-shaped support member 26 being pullable up and out of the first and second bases 18, 20 only when each of the first, second, third, and fourth extensions 44, 46, 90, 92 is retracted.

In operation, the bed rail 10 may be shipped in a disassembled state having parts or pieces or units A, B, C, D, E, and F as shown in FIG. 1. Part A is sheeting 14. Part B is the combination of base 18, upper tube frame cross portion 48, lower tube frame cross portion 60, tube portion 40, strap 110, and counter member 114, where tube portion 40 is disengaged from receptor 36 but strap 110 is engaged to base 18. Part C is the combination of base 20, upper tube frame cross portion 50, lower tube frame cross portion 62, tube portion 42, strap 112, and counter member 116, where tube portion 42 is disengaged from receptor 38 but strap 112 is engaged to base 20. Part D is L-shaped tube portion 72, i.e., the combination of upper end member 78, transition tube portion 82, and straight tube portion 80. Part E is L-shaped portion 74, i.e., the combination of end member 84, transition tube portion 88, and straight tube portion 86. Part F is straight tube portion 76.

The end user then assembles the bed rail 10. The first step in the assembly process is to position units D, E, and F inside of sheeting 14, and further position cross member portions 48, 50, 60, 62 within the sheeting 14 but leaving bases 18, 20, straps 110, 112, and counter members 114, 116 outside of the sheeting 14. Units B, C, D, E, and F, or portions thereof, are passed through openings 248, 250 in the sheeting 14. Then units B, C, D, E, and F, or portions thereof, are engaged to each other while within sheeting 14.

Within the sheeting 14, units D, F and E are connected to form the U-shaped frame member 26. The connection between pieces D and F is made by pressing in button 102 and sliding male end portion 98 into female end portion 100 until button 102 engages a button receiving hole in straight portion 80 of piece D. The connection between pieces E and F is made by pressing in button 108 and sliding male end portion 104 into female end portion 106 until button 108 engages a button receiving hole in straight portion 86 of piece E. Straight tube portions 76, 80, and 86 are disposed in the sleeve 252 formed between a) engaged quick connect pieces 134 of the front and back of the sheeting 14 and b) the upper edge portion 122 of sheeting 14.

Within sheeting 14, another step in the assembly process is the step of connecting pieces B and C. This step is carried out by, at the same time, a) connecting male member portion 52 to female member portion 54 using button 56 and button hole 58, and b) connecting male member portion 64 to female member portion 66 using button 68 and button hole 70 such that cross members 22, 24 are formed.

Another step in the assembly process is engaging the U-shaped cross member 26 to the now assembled combination of parts B and C, i.e., the combination having bases 18, 20 and cross members 22, 24. This step is carried out by pressing in the buttons 90, 92 at the lower ends of the end members 78, 84, pulling out the locks 44, 46 so as to clear the through openings 28, 30, and then inserting the end members 78, 84 into the through openings 28, 30 until the buttons 90, 92 emerge from the bottommost openings of the through openings 28, 30 and until the buttons 90, 92 extend to a locked position, upon which locks 44, 46 can be pressed in to engage holes 94, 96 in the end members 78, 84. This is the pushed up position where four locks, i.e., locks 90, 92, 44, and 46, prevent the U-shaped frame member 26 from sliding axially in either the up or down direction in the bases 18, 20.

Then the tube portions 40, 42 may be inserted into their respective foot receptors 36, 38 and locked therein with pins 184 engaging pin receptor holes 186. Prior to such, such as when being shipped, tube portions 40, 42 can be disposed parallel to and adjacent to cross member portions 48, 50, 60, 62.

Then the bed rail 10 may be engaged to bed 138. This step may be carried out in part by inserting tube portions 40, 42 between the mattress 140 and mattress support 142. This step is further carried out by removing the mattress 140 from the bed 138 and then laying the straps 110, 112 across the upper surface of the mattress support 142. Or this step may be carried out in part by sliding the straps 110, 112 from the foot end junction of the mattress 140 and mattress support 142 toward the head end of the bed 138 without removing the mattress 140 from the bed 138. Or this step may be carried out by, in a lateral direction, partially inserting the counter members 114, 116 between the mattress 140 and mattress support 142, then walking around the bed 138 to the far side 152 of the bed 138 and inserting one's hand in a lateral direction between the mattress 140 and mattress support 142 to first grab one counter member 114, 116 and pull it to the far side 152 and second grab the other counter member 114, 116 and pull it to the far side 152. Then the counter members 114, 116 are set on the far side 152 of the bed 138. Then the end user walks back to the near side 150 of the bed 138 and pulls the proximal ends of the straps 110, 112 so as to pinch the mattress 140 between the counter members 114, 116 and the rear side of the bases 18, 20 having the extensions 170, 172, so as to draw the extensions 170, 172 and the cross members 22, 24 adjacent to the near side 150 of the bed 138, and so as to close any gap that may otherwise form between the bed rail 10 and the near side 150 of the bed 138.

Then, during the night or during a nap during the day, the U-shaped frame member 26 may be pulled up to the pulled up position where the locks 44, 46 are locked.

Then, during the daytime, locks 44, 46 may be unlocked and the U-shaped frame member 26 may be pushed to the pushed down position where upper cross member 109 is disposed adjacent to the upper cross member 22. It should be noted that cross member 24 may be referred to as a lowermost cross member, cross member 22 may be referred to as an intermediate cross member, and that cross member 109 may be referred to as the uppermost cross member. In the pushed down position, the sheeting 14 is scrunched between cross members 22 and 109. When the U-shaped frame member 26 is pulled up to the pulled up position, the sheeting 14 expands.

When a person, such as a child, rolls or moves against the sheeting 14 of the bed rail 10, pressure is applied against the sheeting 14, which in turn applies pressure against the end members 78, 84, which in turn applies pressure against the bases 18, 20, which in turn applies pressure to the counter member arrangement 16, including counter members 114, 116. As to such pressure, it should be noted that there is an elongate arrangement or surface of contact between the end members 78, 84 and the bases 18, 20. In other words, such pressure is not applied at one point on a left side of the bed rail 10 and at one point on a right side of the bed rail 10.

To remove the bed rail 10 from the bed 138, the straps 110, 112 are loosened by pivoting lock 212 on the underside of each of the bases 18, 20. Then the caretaker can walk around to the far side 152 of the bed 138, pivot the counter members 114, 116 ninety degrees, and push the counter members 114, 116 in the direction of the near side 150 of the bed 138. Then the caretaker can walk around to the near side 150 of the bed 138, and pull on the individual straps 110, 112 until the counter members 114, 116 emerge at the near side 154 of the bed 138 or pull on the frame 12 of the bed rail 10 to pull the tube portions 40, 42, straps 110, 112, and counter members 114, 116 from the bed 138.

Then, to disassemble the bed rail 10 or to remove the sheeting 14 for washing, a first step may be to disengage the U-shaped frame member 26 from the bases 18, 20. Then unit D can be disengaged from unit F, and unit F can be disengaged from unit E. Also, units B and C are disengaged from each other. Then the units B, C, D, E, and F can be removed from the sheeting 14 such that sheeting 14 can be washed.

It should be noted that where structure is described with respect to one of the bases 18, 20, such structure is also found on the other of the bases 18, 20. It should be noted that where structure is described with respect to the left side of the bed rail 10, such structure is also present on the right side of the bed rail 10.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A pull up push down bed rail for a bed, the bed having a sleeping surface, the pull up push down bed rail comprising:

a) first and second bases that engage the bed;

b) each of the first and second bases having a through opening, the through opening having an uppermost portion and a bottommost portion;

c) a U-shaped support member having first and second end portions and a cross portion extending between the first and second end portions, the first end portion engaging the through opening of the first base and the second end portion engaging the through opening of the second base, the cross portion of the U-shaped support member being disposed at a location higher than the first and second bases;

d) the U-shaped support member having a pulled up position and a pushed down position, the cross portion of the U-shaped support member being spaced from the first and second bases and further being disposed at a location higher than the sleeping surface of the bed when the U-shaped support member is in the pulled up position, the cross portion of the U-shaped support member being adjacent to the first and second bases when the U-shaped support member is in the pushed down position;

e) an upper cross support member extending between the first and second bases, a lower cross support member extending between the first and second bases, the upper and lower cross support members fixing the first and second bases apart from each other;

f) the upper and lower cross support members defining a first plane, the U-shaped support member defining a second plane, the first and second planes being offset from each other, the first and second planes being adjacent to each other;

g) the first plane being between the bed and the second plane so as to dispose the upper and lower cross support members adjacent to a near side of the bed and minimize any gap between the upper and lower cross support members and a side of the bed; and h) wherein each of the first and second bases comprises a rear portion, the rear portion having upper and lower extensions that extend toward the near side of the bed, each of the upper extensions having an upper seat for receiving one end of the upper cross support member, each of the lower extensions having a lower seat for receiving one end of the lower cross support member such that the upper and lower extensions and upper and lower cross support members are disposed adjacent to the near side of the bed.

2. The pull up push down bed rail of claim 1:

a) wherein the first base includes a first foot extending transversely of an axis of the through opening of the first base;

b) wherein the second base includes a second foot extending transversely of an axis of the through opening of the second base;

c) wherein each of the first and second feet extends rearwardly so as to extend into the near side of the bed, each of the first and second feet including a receptor for engagement to an arrangement that engages a far side of the bed.

3. The pull up push down bed rail of claim 2, wherein the first base and first foot are integral and one-piece with each other, and wherein the second base and second foot are integral and one-piece with each other.

4. The pull up push down bed rail of claim 2, wherein the first base and first foot are part of a first rigid piece, and wherein the second base and second foot are part of a second rigid piece.

5. The pull up push down bed rail of claim 1 and further comprising sheeting, the sheeting comprising:

a) a front sheet portion, a rear sheet portion, a top edge portion, a bottom edge portion, a first upper end portion, a pair of first lower end portions, a second upper end portion, and a pair of second lower end portions;

b) the front sheet portion being spaced from the rear sheet portion by the top edge portion, the bottom edge portion, the first upper end portion, and the second upper end portion;

c) the top edge portion of the sheeting engaging the cross portion of the U-shaped support member, the bottom edge portion of the sheeting engaging the lower cross support member, the first upper end portion of the sheeting engaging the first end portion of the U-shaped support member, the second upper end portion of the sheeting engaging the second end portion of the U-shaped support member;

d) the first lower end portions of the sheeting being spaced from each other to create a space for the first base, the second lower end portions of the sheeting being spaced from each other to create a space for the second base;

e) such that the cross portion of the U-shaped support member is inside of the sheeting;

f) such that sections of the first and second end portions of the U-shaped support member are inside of the sheeting, with other sections of the first and second end portions of the U-shaped support member being in the first and second bases;

g) such that each of the upper and lower cross support members are inside of the sheeting; and h) such that each of the first and second bases are outside of the sheeting.

* * * * *